US009037025B2

(12) United States Patent
Kodera

(10) Patent No.: US 9,037,025 B2
(45) Date of Patent: May 19, 2015

(54) FIXING DEVICE, AND IMAGE FORMING APPARATUS WITH SAME

(71) Applicant: FUJI XEROX CO., LTD., Tokyo (JP)

(72) Inventor: Tetsuro Kodera, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/258,518

(22) Filed: Apr. 22, 2014

(65) Prior Publication Data

US 2015/0093170 A1 Apr. 2, 2015

(30) Foreign Application Priority Data

Oct. 2, 2013 (JP) ..... 2013-207648

(51) Int. Cl.
*G03G 15/20* (2006.01)

(52) U.S. Cl.
CPC ..... *G03G 15/2007* (2013.01)

(58) Field of Classification Search
CPC ..... G03G 15/2078; G03G 15/2064; G03G 2221/1639; G03G 2215/1695; G03G 15/161; G03G 15/2053
USPC ..... 399/400, 33, 67, 122, 307, 320
See application file for complete search history.

(56) References Cited

U.S. PATENT DOCUMENTS

| | | | | |
|---|---|---|---|---|
| 5,436,710 | A | 7/1995 | Uchiyama | |
| 2011/0038653 | A1* | 2/2011 | Egusa et al. | 399/336 |
| 2011/0236821 | A1* | 9/2011 | Kageyama | 430/124.1 |
| 2012/0045238 | A1* | 2/2012 | Maeda | 399/67 |

FOREIGN PATENT DOCUMENTS

| | | |
|---|---|---|
| JP | A-53-6044 | 1/1978 |
| JP | A-6-301304 | 10/1994 |
| JP | A-2011-128223 | 6/2011 |

* cited by examiner

*Primary Examiner* — Roy Y Yi
(74) *Attorney, Agent, or Firm* — Oliff PLC

(57) ABSTRACT

Provided is a fixing device including a transparent cylindrical body that is formed in a cylindrical shape to be rotatable, an opposing member that is arranged to oppose the transparent cylindrical body and forms a contact region in a portion between the transparent cylindrical body and the opposing member, a laser beam radiation device that is provided in an external portion of the transparent cylindrical body and radiates the laser beams, a light converging member that is provided in an internal portion of the transparent cylindrical body and is disposed to be in contact with portions of the transparent cylindrical body, and a liquid filling body that fills an air interface layer between a portion of the transparent cylindrical body and the light converging member, with a transparent liquid enabling the laser beams to pass therethrough.

8 Claims, 17 Drawing Sheets

FIXING DEVICE, AND IMAGE FORMING APPARATUS WITH SAME

CROSS-REFERENCE TO RELATED APPLICATIONS

This application is based on and claims priority under 35 USC 119 from Japanese Patent Application No. 2013-207648 filed Oct. 2, 2013.

BACKGROUND

Technical Field

The present invention relates to a fixing device, and an image forming apparatus with the same.

SUMMARY

According to an aspect of the invention, there is provided a fixing device including:

a transparent cylindrical body that is formed in a cylindrical shape to be rotatable and is made of a transparent material enabling laser beams to pass therethrough;

an opposing member that is arranged to oppose the transparent cylindrical body and forms a contact region in a portion between the transparent cylindrical body and the opposing member and that transports a recording material in the contact region along with the transparent cylindrical body;

a laser beam radiation device that is provided in an external portion of the transparent cylindrical body and radiates the laser beams onto a predetermined light incident position on the transparent cylindrical body;

a light converging member that is provided in an internal portion of the transparent cylindrical body and is disposed to be in contact with portions of the transparent cylindrical body, which at least corresponds to the contact region between the opposing member and the transparent cylindrical body and corresponds to the light incident position and that presses, in the contact region, the transparent cylindrical body to an opposing member side and converges the laser beams, which are radiated onto the light incident position so as to be applied to an image on the recording material, in a transporting direction of the recording material, in the contact region; and a liquid filling body that, when the transparent cylindrical body rotates, fills an air interface layer between a portion of the transparent cylindrical body, which at least corresponds to the light incident position, and the light converging member, with a transparent liquid enabling the laser beams to pass therethrough.

BRIEF DESCRIPTION OF THE DRAWINGS

Exemplary embodiments of the present invention will be described in detail based on the following figures, wherein.

DETAILED DESCRIPTION

Overview of Exemplary Embodiment

Figure 1:
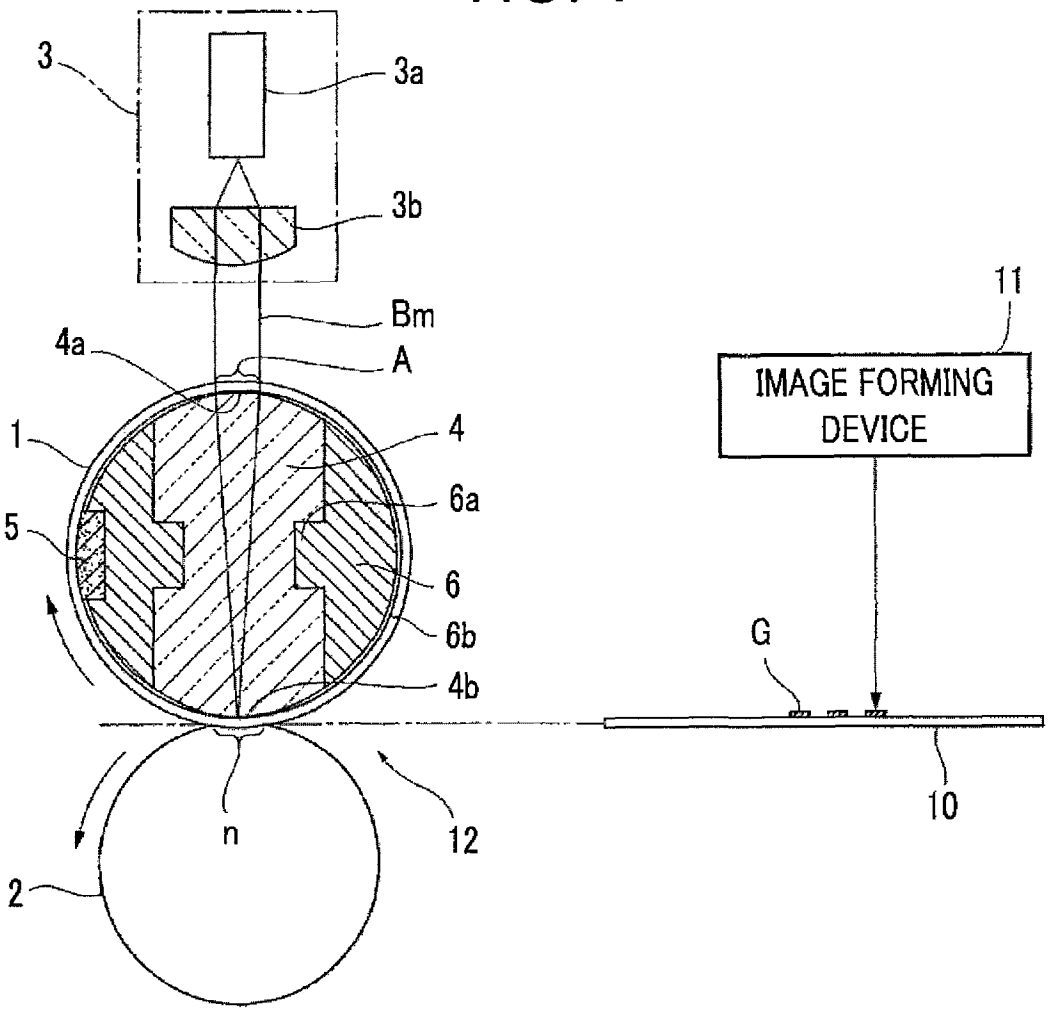
FIG. 1 is a view illustrating an overview of an embodiment of an image forming apparatus which includes a fixing device according to an exemplary embodiment of the invention.

FIG. 1 illustrates an overview of an embodiment of an image forming apparatus which includes a fixing device according to an exemplary embodiment of the invention.

An image forming apparatus illustrated in FIG. 1, includes an image forming device 11 which forms an unfixed image G on a recording material 10, and a fixing device 12 which transports the recording material 10 on which the unfixed image G formed by the image forming device 11 is held and fixes the unfixed image G on the recording material 10.

In this example, an image forming device of any type, including an electrophotographic type, an electrostatic recording type using an ionic current, or the like, may be appropriately selected as the image forming device 11 as long as it requires the fixing device 12 to form the unfixed image G.

In addition, the fixing device 12 used in this exemplary embodiment may include a transparent cylindrical body 1 which is formed in a cylindrical shape to be rotatable and is constituted by a transparent material enabling laser beams Bm to pass therethrough, an opposing member 2 which is arranged to oppose the transparent cylindrical body 1 and forms a contact region n in a portion between the transparent cylindrical body 1 and the opposing member 2 and which, along with the transparent cylindrical body 1, transports the recording material 10 in the contact region n, a laser beam radiation device 3 which is provided in an external portion of the transparent cylindrical body 1 and radiates the laser beams Bm onto a predetermined light incident position A on the transparent cylindrical body 1, a light converging member 4 which is provided in an internal portion of the transparent cylindrical body 1 and is disposed to be in contact with portions of the transparent cylindrical body 1 which are at least portions corresponding to the contact region n between the opposing member 2 and the transparent cylindrical body 1 and corresponding to the light incident position A and which presses, in the contact region n, the transparent cylindrical body 1 to the opposing member 2 side and converges the laser beams Bm, which are radiated onto the light incident position A so as to be applied to the image G on the recording material 10, in a transporting direction of the recording material 10, in the contact region n, and a liquid filling body 5 which, when the transparent cylindrical body 1 rotates, fills an air interface layer between a portion of the transparent cylindrical body 1, which is at least a portion corresponding to the light incident position A, and the light converging member 4, with a transparent liquid enabling the laser beams Bm to pass therethrough.

In these technical means, the transparent cylindrical body 1 may be either a rigid body or an elastomer as long as it is formed in a cylindrical shape and constituted by a transparent material. In addition, there is no problem even when the transparent cylindrical body 1 has a single layer structure. However, the transparent cylindrical body 1 may be constituted by plural functional layers, in consideration of ensuring strength, ensuring the contact region n between the transparent cylindrical body 1 and the opposing member 2, release properties relative to the image G, and the like.

Furthermore, an opposing member of any configuration may be appropriately selected as the opposing member 2 as long as it ensures the contact region n between the transparent cylindrical body 1 and the opposing member 2 and transports, along with the transparent cylindrical body 1, the recording material 10 in a state where the recording material 10 is pinched by the transparent cylindrical body 1 and the opposing member 2. In terms of effective usage of the laser beams Bm which pass through the recording material 10, it is preferable that the opposing member 2 has a reflecting surface enabling the laser beams Bm to be reflected.

Furthermore, the laser beam radiation device 3 may radiate the laser beams Bm onto the predetermined light incident position A on the transparent cylindrical body 1. In terms of improvement in light-converging properties by the light converging member 4, it is preferable that a bundle of the parallel laser beams Bm be applied onto the light incident position A of the transparent cylindrical body 1. In this case, for example, an optical member 3*b* (such as a collimator lens) may be used to convert the laser beams Bm radiated from a laser beam source 3*a* into parallel laser beams.

The light converging member 4 may be designed to have the optimal depth of focus, under the consideration of a distance from a light incident portion 4*a* to a light emission portion 4*b*.

Needless to say, the light converging member 4 basically has a light converging function. However, in addition to the converging function, it is required that the light converging member 4 come into contact with portions of the transparent cylindrical body 1, which correspond to the light incident position A and the contact region n, and pressurizes the image G on the recording material 10 in the contact region n. In this case, a pressurizing force may be appropriately set within a range in which predetermined fixing properties are ensured under the consideration of a relationship between the pressurizing force and a heating energy of the laser beams Bm.

In this exemplary embodiment, a simultaneous pressing and heating method in which a predetermined irradiated region p is heated by the laser beams Bm in a state where the image G on the recording material 10 is pressurized in the contact region n between the transparent cylindrical body 1 and the opposing member 2. Thus, upon comparison with a method in which the image G is fixed, in a non-contact state, in a heating manner using the laser beams Bm, the surface of the image G becomes more even, owing to the pressurization. Accordingly, it is easy to improve gloss degrees (glossiness). Furthermore, the fixing properties are improved by the pressurization, and thus it is possible to reduce radiation energy of laser beams.

Figure 2A:
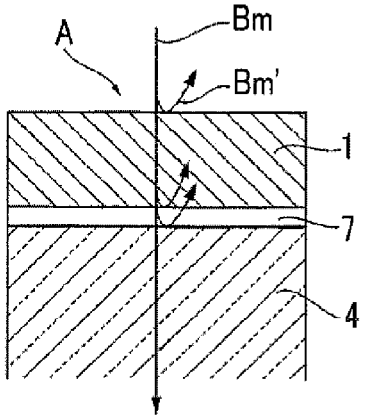
FIG. 2A is a view illustrating a transmission state of laser beams in a fixing device used in a comparative example and FIG. 2B is a view illustrating a transmission state of laser beams in a fixing device used in the exemplary embodiment.
Figure 2B:
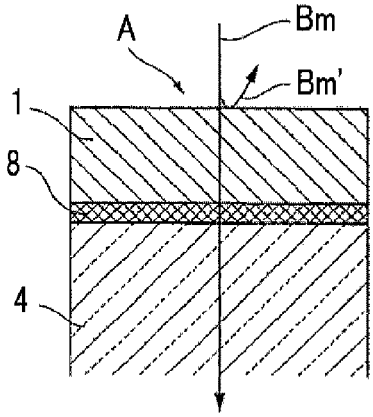

A liquid filling body of any configuration may be appropriately selected as the liquid filling body 5 as long as it fills an air interface layer 7 (see FIG. 2A) between the light incident position A of the transparent cylindrical body 1 and the light converging member 4, with at least transparent liquid 8 (see FIG. 2B). It is preferable that the "transparent liquid 8" mentioned above be a liquid (for example, silicone oil, fluorine oil, or the like) having optical transparent properties and low viscous resistance.

When the air interface layer 7 is present, in the light incident position A of the transparent cylindrical body 1, between the transparent cylindrical body 1 and the light converging member 4, as in a comparative example illustrated in FIG. 2A, the incident laser beams Bm are reflected in the interface, as shown by Bm' in FIG. 2A. Thus, radiation efficiency of the laser beams Bm is deteriorated. Upon comparison with an aspect (an aspect in which the air interface layer 7 is present) illustrated in FIG. 2A, when the air interface layer 7 of this exemplary embodiment is filled with the transparent liquid 8, reflection of the incident laser beams Bm by the air interface layer 7 is suppressed, as illustrated in FIG. 2B. Accordingly, the radiation efficiency of the laser beams Bm is improved.

Next, a representative aspect or a preferable aspect of the fixing device according to the exemplary embodiment will be described.

First, a representative aspect of the light converging member 4 has the light incident portion 4*a* and the light emission portion 4*b*. The light incident portion 4*a* is formed in a portion corresponding to the light incident position A on the transparent cylindrical body 1 and is bent in a direction along a rotating direction of the transparent cylindrical body 1. The light emission portion 4*b* is formed in a portion corresponding to the contact region n between the transparent cylindrical body 1 and the opposing member 2 and is bent in a direction along the rotating direction of the transparent cylindrical body 1.

In this example, the light incident portion 4*a* and the light emission portion 4*b* of the light converging member 4 are portions which come into contact with the rotating transparent cylindrical body 1. Thus, when the light incident portion 4*a* and the light emission portion 4*b* are bent in the direction along the rotating direction of the transparent cylindrical body 1, contact resistance between the transparent cylindrical body 1 and the light incident portion 4*a* or the light emission portion 4*b* is reduced.

A preferable aspect of the light converging member 4 has the light incident portion 4*a* which is formed in the portion corresponding to the light incident position A on the transparent cylindrical body 1 and is bent in the direction along the rotating direction of the transparent cylindrical body 1, in which the light incident portion 4*a* is bent to have a radius of curvature equal to or smaller than a radius of curvature of an internal surface of the transparent cylindrical body 1. In this case, when the radius of curvature of the light incident portion 4*a* (a bent portion) of the light converging member 4 is set to be greater than the radius of curvature of the transparent cylindrical body 1, the air interface layer 7 (see FIG. 2A) in which a gap in the vicinity of a middle portion is large is likely to be formed between the transparent cylindrical body 1 and the light incident portion 4*a* of the light converging member 4. In contrast, in a case of the aspect described above, it is difficult for the air interface layer 7 to have a large gap in the vicinity of the middle portion of the light incident portion 4*a*. As a result, the light converging member 4 of the aspect described above is preferable in that it is easy for the liquid filling body 5 to fill the air interface layer 7 with the transparent liquid 8.

A structure in which the light converging member 4 is positioned to and held by a holding member 6 provided in the internal portion of the transparent cylindrical body 1 is exemplified as a representative supporting structure of the light converging member 4. In this aspect, the light converging member 4 is positioned to and held by the holding member 6, and thus the laser beams Bm applied from the light incident position A on the transparent cylindrical body 1 pass through the positioned light converging member 4 and converge into the predetermined light converging position.

In the aspect described above, a preferable aspect of the holding member 6 has a holding portion 6*a* which holds the light converging member 4 and a guiding portion 6*b* which is in contact with the internal surface of the transparent cylindrical body 1 and guides a rotational track of the transparent cylindrical body 1. The light converging member 4 is positioned and held by the holding portion 6*a* of the holding member 6 and a rotational traveling of the transparent cylindrical body 1 is guided by the guiding portion 6*b*.

A representative aspect of the liquid filling body 5 is a liquid application member which is provided, in a fixed manner, in the internal space of the transparent cylindrical body 1 and applies the transparent liquid 8 (see FIG. 2B) in a state where the liquid application member is in contact with the internal surface of the transparent cylindrical body 1, except for portions of the internal surface of the transparent cylindrical body 1, which correspond to the light incident position A on the transparent cylindrical body 1 and the contact region n between the transparent cylindrical body 1 and the opposing member 2.

In this aspect, the light incident position A on the transparent cylindrical body 1 and the contact region n between the transparent cylindrical body 1 and the opposing member 2 are areas through which the laser beams Bm from the laser beam radiation device 3 pass. Thus, in terms of preventing the laser beams Bm from being blocked as much as possible, the liquid application member may be installed in a position excluding these areas. Particularly, in terms of filling the air interface layer 7 between a portion of the transparent cylindrical body 1, which corresponds to the light incident position A, and the light converging member 4, with the transparent liquid 8, it is preferable that the liquid application member be positioned in a portion which is located further on an upstream side in the rotating direction of the transparent cylindrical body 1 than the light incident position A and further on a downstream side in the rotating direction of the transparent cylindrical body 1 than the contact region n. In this aspect, the transparent liquid is more than sufficiently supplied to the portion between a portion of the transparent cylindrical body 1 and a portion of the light converging member 4, both of which correspond to the light incident position A on the transparent cylindrical body 1. Thus, it is possible to prevent air from entering the interface due to the insufficient transparent liquid supply.

In an example of an aspect of a driving method of the transparent cylindrical body 1, the transparent cylindrical body 1 is driven by a first driving mechanism and the opposing member 2 is driven by a second driving mechanism. In this aspect, one of the first driving mechanism and the second driving mechanism includes a following element which causes the opposing member 2 to follow the transparent cylindrical body 1 when a circumferential speed of the transparent cylindrical body 1 is different from a circumferential speed of the opposing member 2 in the contact region n. Although the transparent cylindrical body 1 and the opposing member 2 are separately driven in this aspect, it is possible to suppress a difference in the circumferential speeds of both members by installing the following element (for example, a one-way clutch) in one of the first driving mechanism and the second driving mechanism.

In another aspect of the driving method of the transparent cylindrical body 1, the opposing member 2 is driven by a driving mechanism and the transparent cylindrical body 1 moves to follow the opposing member 2. In this case, any mechanism may be applied as the driving mechanism as long as it drives the opposing member 2. In addition, another aspect of the driving method includes an aspect in which the transparent cylindrical body 1 moves, via the contact region n between the transparent cylindrical body 1 and the opposing member 2, to follow the opposing member 2 and an aspect in which the transparent cylindrical body 1 moves, through a driving transmission mechanism to which a driving force of the driving mechanism is transmitted, to follow the opposing member 2.

An aspect of a holding structure of the transparent cylindrical body 1 includes a pressing member which is provided in the vicinity of a portion of an external surface of the transparent cylindrical body 1, which corresponds to the light incident position A, to press the transparent cylindrical body 1 such that a portion of the transparent cylindrical body 1, which corresponds to the light incident position A, is in contact with the light converging member 4. In this aspect, the pressing members may be provided on both sides of the transparent cylindrical body 1, interposing the light incident position A therebetween or the pressing member may be provided on one side thereof. In addition, in terms of a reduction in the contact resistance between the transparent cylindrical body 1 and the pressing member, the pressing member may be constituted by a roller member which may rotate to follow the transparent cylindrical body 1.

Hereinafter, the details of the invention will be described with reference to embodiments illustrated in the accompanying drawings.

First Embodiment

Overall Configuration

Figure 3:
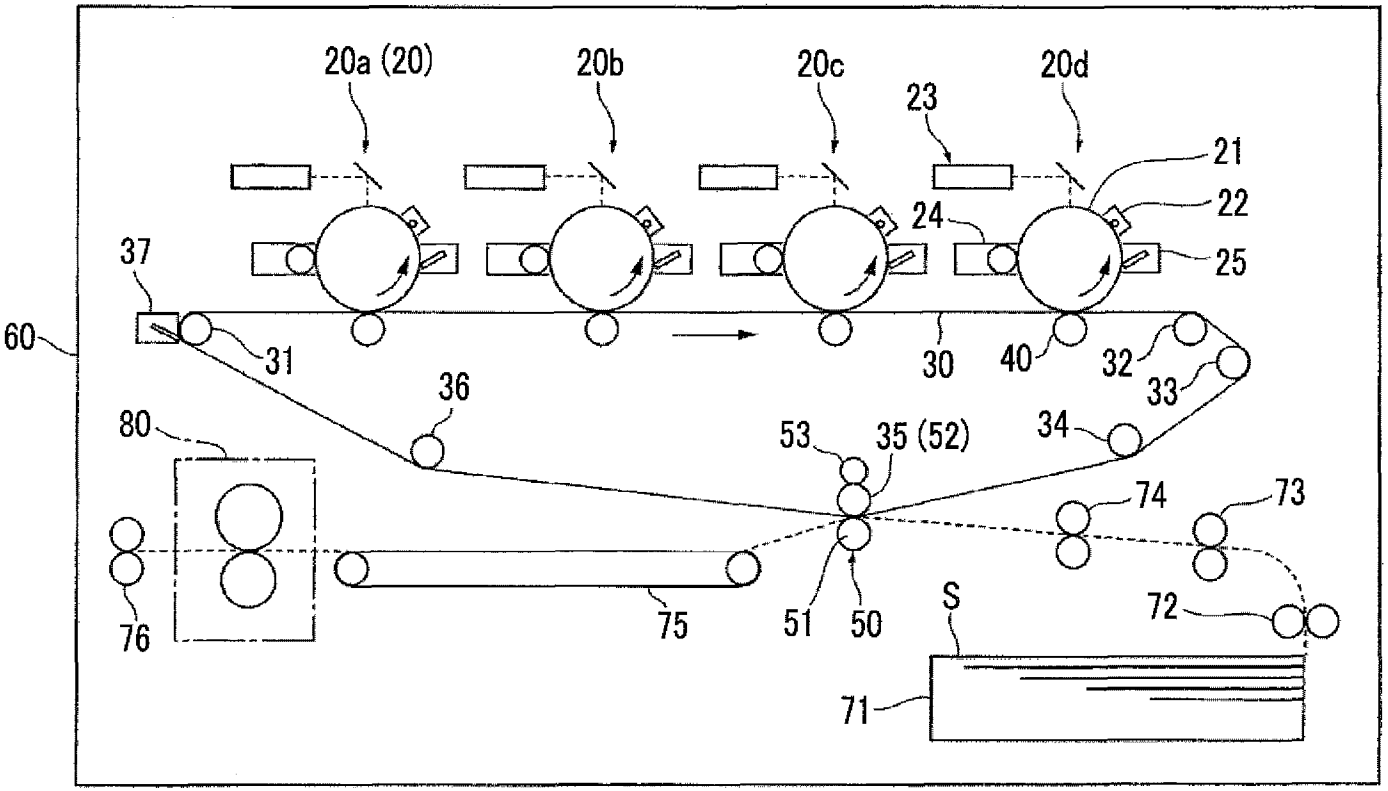
FIG. 3 is a view illustrating an overall configuration of an image forming apparatus according to a first embodiment.

FIG. 3 illustrates an overall configuration of an image forming apparatus according to the first embodiment.

The image forming apparatus in FIG. 3 has plural image forming portions 20 (specifically, image forming portions 20*a* to 20*d*) which form, using image forming materials, images of plural color components (yellow (Y), magenta (M), cyan (C), and black (K), in this example) on a recording material S, an intermediate transfer body 30 which has a belt shape and which temporally holds and transports an image of each color component, which is formed in each image forming portion 20, before the image of each color component is transferred onto the recording material S, a batch transfer device (a secondary transfer device) 50 which transfers, in a batch manner, the images of the respective color components held on the intermediate transfer body 30 onto the recording material S, and a fixing device 80 which fixes the unfixed image which is transferred onto the recording material S by a batch transfer device 50. The image forming portions 20, the intermediate transfer body 30, the batch transfer device 50, and the fixing device 80 are installed in an apparatus housing 60 of the image forming apparatus.

Each image forming portion 20 is basically configured to be an electrophotographic type. Each image forming portion 20 has, for example, a photoconductor 21 which has a drum shape and has a photosensitive layer formed on a surface thereof and which may rotate in a predetermined direction. In the periphery of the photoconductor 21, an electrostatic charging device 22, for example, a corotron, which electrically charges the photoconductor 21 in advance, a latent image recording device 23, such as a laser-beam scanning device, which records, using light beams, an electrostatic latent image on the photoconductor 21 which is electrically charged by the electrostatic charging device 22, a developing device 24 which develops, using toner of each color component, the electrostatic latent image recorded by the latent image recording device 23, and a cleaning device 25 which cleans the residual toner or the like on the photoconductor 21 are provided in order.

In addition, the intermediate transfer body 30 is constituted by a belt member which is wound around plural support rollers 31 to 36 and rotates in a predetermined direction in a circulation manner, in which the support roller 31, for example, is used as a driving roller and the other support rollers 32 to 36 are used as driven rollers. In this example, the support roller 33 functions as a tension applying roller that applies a predetermined tension to the intermediate transfer body 30. The support roller 35 functions as an opposing roller 52 which is a component of the batch transfer device 50.

Furthermore, a primary transfer device 40 is provided on a back surface of the intermediate transfer body 30 which faces the respective image forming portions 20 (the image forming portions 20*a* to 20*d*). In this example, the primary transfer device 40 has, for example, a transfer roller to which a primary transfer voltage is applied. The primary transfer device 40 performs a primary transfer of the image on the photoconductor 21 onto the intermediate transfer body 30 by forming a primary transfer electric field between the transfer roller and the photoconductor 21.

A member indicated by a reference numeral 37 is an intermediate transfer body cleaning device for cleaning off the residual toner or the like on the intermediate transfer body.

In the batch transfer device (the secondary transfer device) 50, the support roller 35 of the intermediate transfer body 30 is used as the opposing roller 52. In addition, a transfer roller 51 is provided on the surface side of the intermediate transfer body 30, which is a side opposite the opposing roller 52. Furthermore, an electric power supplying roller 53 is provided on a surface of the opposing roller 52. In this example, the batch transfer device 50 applies a batch transfer voltage (a secondary transfer voltage) to the electric power supplying roller 53 and the transfer roller 51 is grounded. Thus, a batch transfer electric field (a secondary transfer electric field) is formed between the transfer roller 51 and the intermediate transfer body 30, whereby the batch transfer device 50 batch-transfers the image of each color component on the intermediate transfer body 30 to the recording material S.

The recording material S is received in a recording material receiving device 71 and fed from the recording material receiving device 71 one by one. Then, the recording material S passes through an appropriate number of transport rollers 72 and 73 and is transported to a positioning roller 74. The recording material S is positioned by the positioning roller 74, and then is transported to a batch transfer region of the batch transfer device 50. Subsequently, the recording material S passes through the batch transfer region and a transport belt 75, and then is transported to the fixing device 80. Next, the recording material S passes through a discharging roller 76 and is discharged to a discharged recording material receiving portion (not illustrated).

Fixing Device

Figure 4:
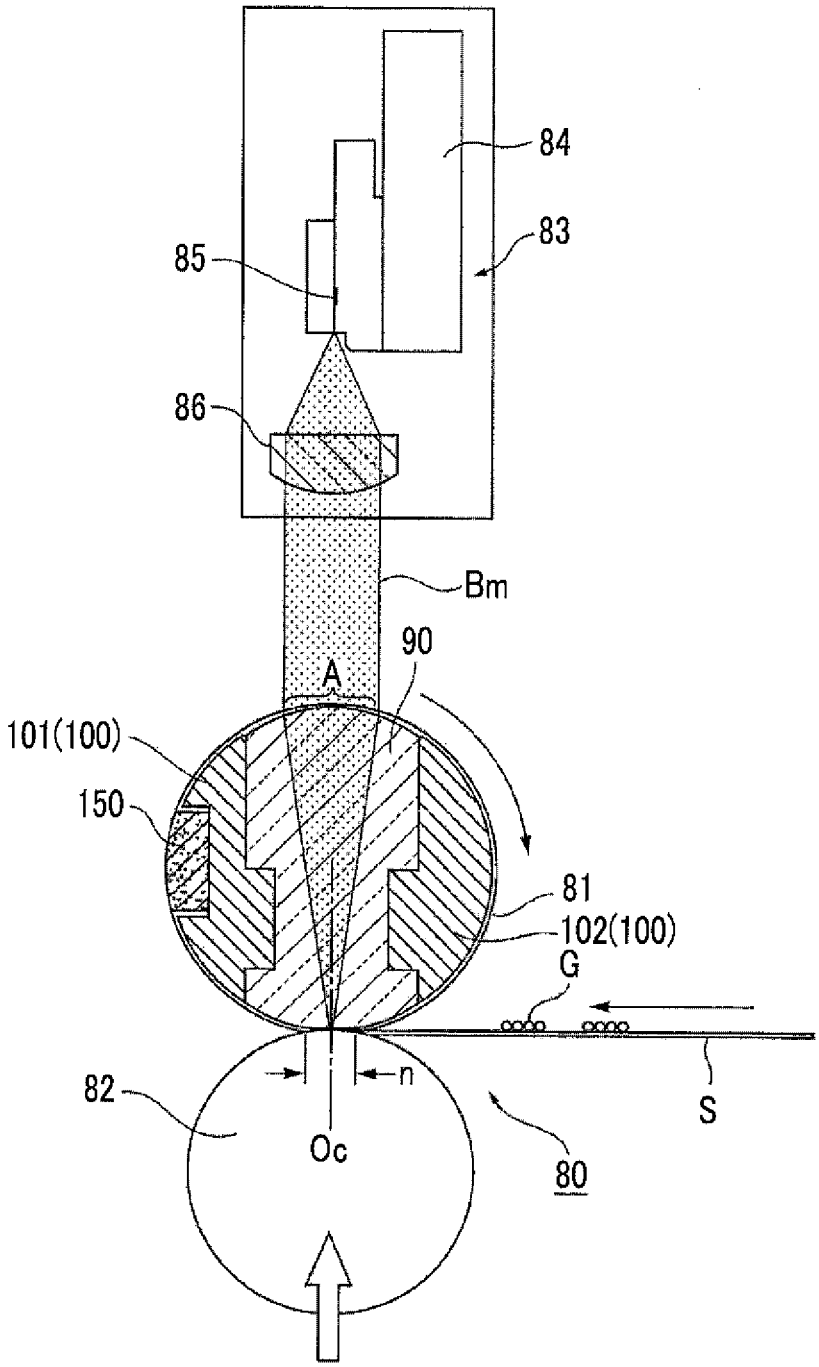
FIG. 4 is a view illustrating an overall configuration of a fixing device used in the first embodiment.

In addition, the fixing device 80 in this exemplary embodiment includes a transparent tube 81 which is formed in a cylindrical shape to be rotatable and is constituted by a transparent material enabling the laser beams Bm to pass therethrough, as illustrated in FIG. 4, an opposing roller 82 which is arranged to oppose the transparent tube 81 and forms the contact region n in a portion between the transparent tube 81 and the opposing roller 82 and which, along with the transparent tube 81, transports the recording material S, a laser beam radiation device 83 which is provided in an external portion of the transparent tube 81 and radiates the laser beams Bm onto the predetermined light incident position A on the transparent tube 81, a lens pad 90 as a pressurizing and light converging member which is provided in an internal portion of the transparent tube 81 and presses, in the contact region n between the lens pad 90 and the transparent tube 81, the transparent tube 81 to the opposing roller 82 side and which converges the laser beams Bm, which are radiated onto the light incident position A on the transparent tube 81 so as to be applied to the image G on the recording material S, in the transporting direction of the recording material S, in the contact region n.

Transparent Tube

In this example, the transparent tube 81 being transparent means that the transparency of the transparent tube 81 is sufficiently high in a wavelength range of the laser beam Bm. Degrees of the transparency of the transparent tube 81 are not limited as long as they are enough to enable the laser beam Bm to pass through the transparent tube 81. In terms of light use efficiency or prevention of heating of the lens pad 90, the higher the degree of the transparency is, the better it is. For example, the degree of the transparency is equal to or more than 90% and, preferably, equal to or more than 95%.

Figure 8:
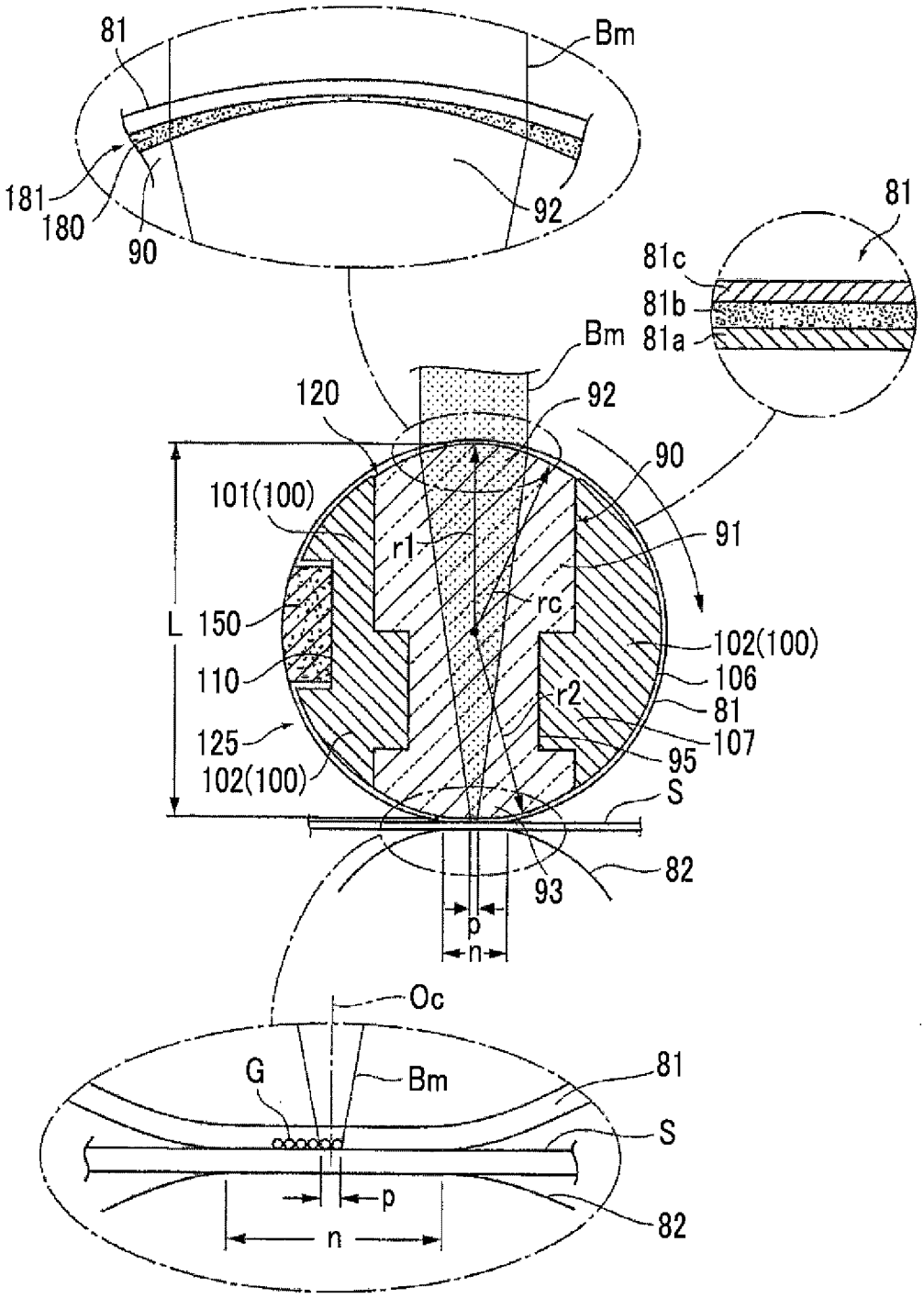
FIG. 8 is a view illustrating a portion of a transparent tube of the fixing device used in the first embodiment, which corresponds to a light incident position, behavior of laser beams in a light emission position, and an example of a cross-sectional configuration of the transparent tube.

The transparent tube 81 is configured to have three layers, as illustrated in FIGS. 4 and 8. The three layers are a base material layer 81*a* for ensuring a required rigidity, an elastic layer 81*b* which is laminated on the base material layer 81*a*, and a release layer 81*c* which allows the toner as an image forming material, which is laminated on the elastic layer 81*b*, to be easily released. Furthermore, the transparent tube 81 of this exemplary embodiment is not limited to the three-layer structure. Needless to say, the transparent tube 81 may have an appropriate number of layers, under consideration of functions thereof.

Examples of materials forming the base material layer 81*a* include polyvinylidene fluoride (PVDF), polyimide (PI), polyethylene (PE), polyurethane (PU), silicone such as polydimethylsiloxane (PDMS), polyether ether ketone (PEEK), polyether sulfone (PES), fluorinated ethylene propylene (FEP), ethylene tetrafluoroethylene copolymer (ETFE), chlorotrifluoroethylene (CTFE), polyvinylidene fluoride (PVDF), polyvinyl fluoride (PVF), polytetrafluoroethylene (PTFE), and material selected from the group consisting of a mixture thereof.

The elastic layer 81*b* is constituted by LSR silicone rubber, HTV silicone rubber, RTV silicone rubber, or the like. The elastic layer 81*b* may have any configuration as long as it enables the laser beam Bm to pass therethrough and has elasticity allowing level differences of the image G due to irregularities of the recording material S or the toner to be absorbed.

The release layer 81*c* is constituted by fluorine polymer, for example, tetrafluoroethylene polymer (PTFE), tetrafluoroethylene perfluoroalkoxyethylene ethylene copolymer (PFA), hexafluoropropylene copolymer of tetrafluoroethylene (FEP). The release layer 81*c* may have any configuration as long as it enables the laser beam BM to pass therethrough and encourages releasing of the image G, which is formed on the recording material S using the toner, from the transparent tube 81. Furthermore, the release layer 81*c*, along with the elastic layer 81*b*, also imparts a preferable gloss to the fixed image.

Opposing Roller

The opposing roller 82 is constituted by, for example, aluminum, stainless steel, or a copper plate coated with nickel or the like. The opposing roller 82 is disposed such that a predetermined pressurizing force is applied to the portion between the transparent tube 81 and the opposing roller 82.

Laser Beam Radiation Device

The laser beam radiation device 83 has a laser beam radiation array 84 in which plural laser beam sources 85 are arrayed. A collimator lens 86 as an optical member which causes the laser beams Bm radiated from the laser beam sources 85 of the laser beam radiation array 84 to advance in parallel is installed in a housing (not illustrated) of the laser beam radiation device 83. A radiation position and a radiation intensity of the laser beam Bm from the laser beam sources 85 may be appropriately selected in the laser beam radiation device 83.

Lens Pad

Material forming the lens pad 90 may be selected from materials having heat resistance, out of material normally used for forming a lens. Examples of the material forming the lens pad 90 include various optical glass, optical transparent plastic polymer. Examples of the optical transparent plastic polymer include poly diethylene glycol bisallylcarbonate (PADC), polymethylmethacrylate (PMMA), polystyrene (PSt), polymer consisting of a styrene unit and a methyl methacrylate unit (MS polymer), polycarbonate polymer, cycloolefin polymer, fluorene polymer.

Figure 5:
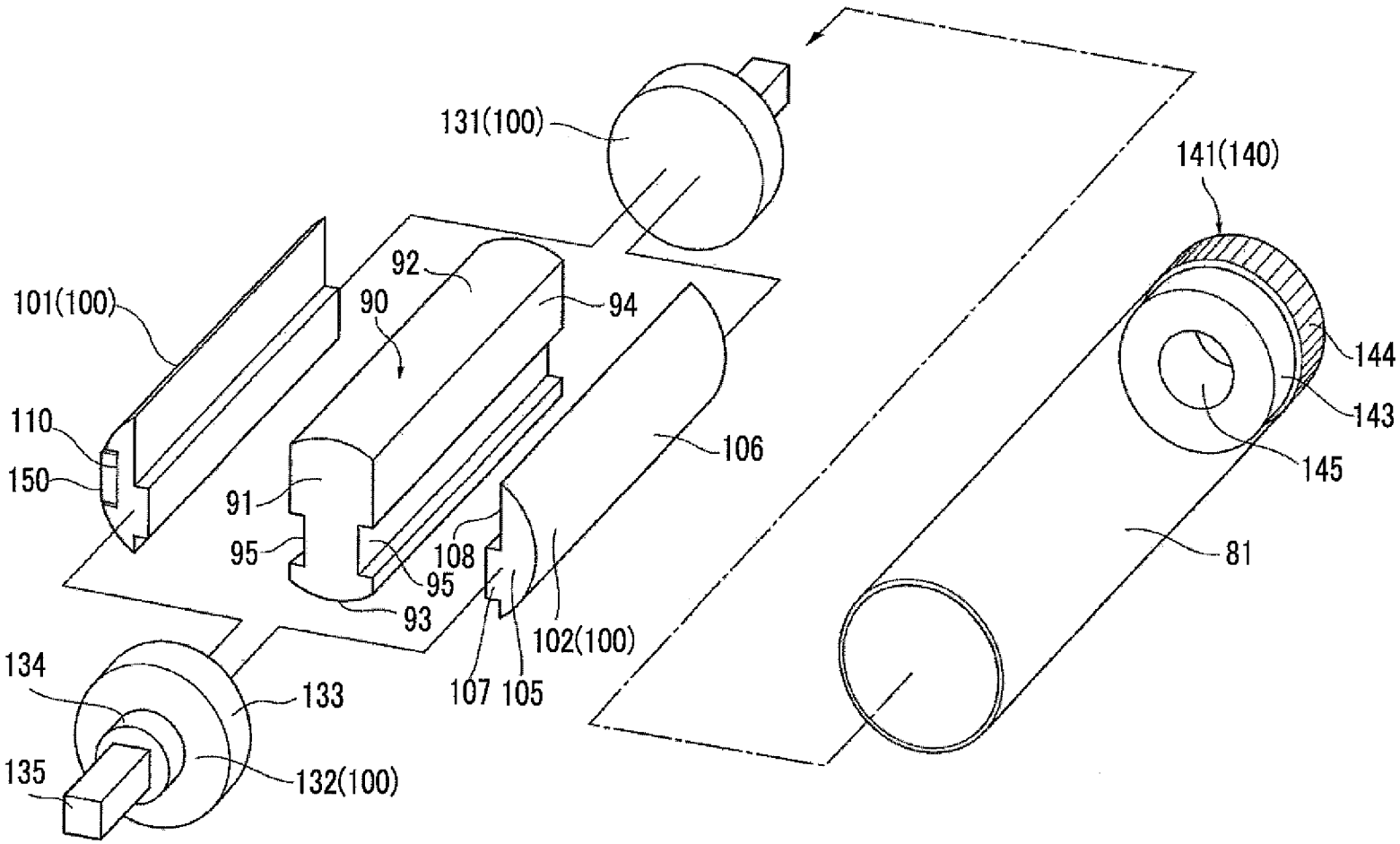
FIG. 5 is an exploded view illustrating each assembling part of a principal portion of the fixing device used in the first embodiment.

The lens pad 90 has a lens main body 91 which converges plural the laser beams Bm radiated from the laser beam radiation array 84 in a laser-beam passing direction, as illustrated in FIGS. 4 and 5. The lens main body 91 is constituted by a long lens member which extends in a longitudinal direction of the laser beam radiation array 84. The lens main body 91 has a light incident portion 92 and a light emission portion 93. The light incident portion 92 is formed in a portion corresponding to the light incident position A of the transparent tube 81 and is bent in the direction along the rotating direction of the transparent tube 81. The light emission portion 93 is formed in a portion corresponding to the contact region n between the transparent tube 81 and the opposing roller 82 and is bent in the direction along the rotating direction of the transparent tube 81. The light incident portion 92 and the light emission portion 93 are disposed to be in contact with the internal surface of the transparent tube 81.

Particularly, in this example, the light incident portion 92 and the light emission portion 93 are bent to have radiuses of curvature r1 and r2 (in this example, r1-r2) which are equal to or smaller than a radius of curvature rc of an internal surface of the transparent tube 81, as illustrated in FIG. 8.

In addition, the radius of curvature r1 of the bent-shaped light incident portion 92 of the lens pad 90 and a distance L between the light incident portion 92 and the light emission portion 93 of the lens pad 90 are set in advance such that the parallel laser beams Bm applied from the light incident position A on the transparent tube 81 are converged to form a focal point, in which the vicinity of a substantially middle portion Oc of the contact region n between the transparent tube 81 and the opposing roller 82 is set to the irradiated region p.

The lens pad 90 has planar portions 94 which are substantially parallel to both sides of the lens main body 91, except the light incident portion 92 and the light emission portion 93. A groove for positioning 95 is integrally formed in a portion of each planar portion 94. A cross-sectional surface of the groove for positioning 95 has a substantially rectangular shape extending in the longitudinal direction of the laser beam radiation array 84.

Transparent Tube and Structure for Supporting Lens Pad

In this example, the lens pad 90 is held, in a fixed manner, in the transparent tube 81 by a holding frame 100.

In this example, the holding frame 100 has a pair of side holding frames 101 and 102 which hold, in a surrounding manner, the lens pad 90 from both sides thereof, and end holding frames 131 and 132 which hold, in a fixing manner and using an adhesive (not illustrated), the lens pad 90 and both end portions of the respective side holding frames 101 and 102 in the longitudinal direction.

In this case, the side holding frames 101 and 102 have long frame members 105 which are integrally formed using metal constituted by aluminum or stainless steel, synthetic polymer, or the like. The frame member 105 has a guiding portion 106 and a positioning protrusion 107. The guiding portion 106 is bent to have a radius of curvature which substantially corresponds to the radius of curvature rc of the internal surface of the transparent tube 81. A cross-sectional surface of the positioning protrusion 107 has a rectangular shape. The positioning protrusion 107 is formed in a part of a holding surface 108 which is formed in a planar shape to face the planar portion 94 of the lens pad 90. The positioning protrusion 107 protrudes to be fitted into the groove for positioning 95 of the lens pad 90. The holding surfaces 108 of the side holding frames 101 and 102 have sizes corresponding to the planar portions 94 of the lens pad 90. When the positioning protrusion 107 is fitted into the groove for positioning 95 of the lens pad 90, both ends of each guiding portion 106 of the side holding frames 101 and 102 in a bent direction do not protrude from extended surfaces of bent trajectories of the light incident portion 92 and the light emission portion 93 of the lens pad 90.

The end holding frames 131 and 132 have end lids 133 of which a cross-sectional surface has a circular shape and which fix both ends of a sub-assembly which has a substantially cylindrical shape and is constituted by assembling the lens pad 90 and a pair of the side holding frames 101 and 102. The end holding frames 131 and 132 further have guiding step portions 134 of which a diameter is smaller than a diameter of the end lid 133 and which project with a predetermined step in a state where the guiding step portions 134 are adjacent to external sides of the end lid 133. In addition, the end holding frames 131 and 132 have spindles 135 of which a cross-sectional surface has a non-circular shape (in this example, a rectangular shape) and which protrude in a state where the spindles 135 are adjacent to external sides of the guiding step portions 134.

Figure 6:
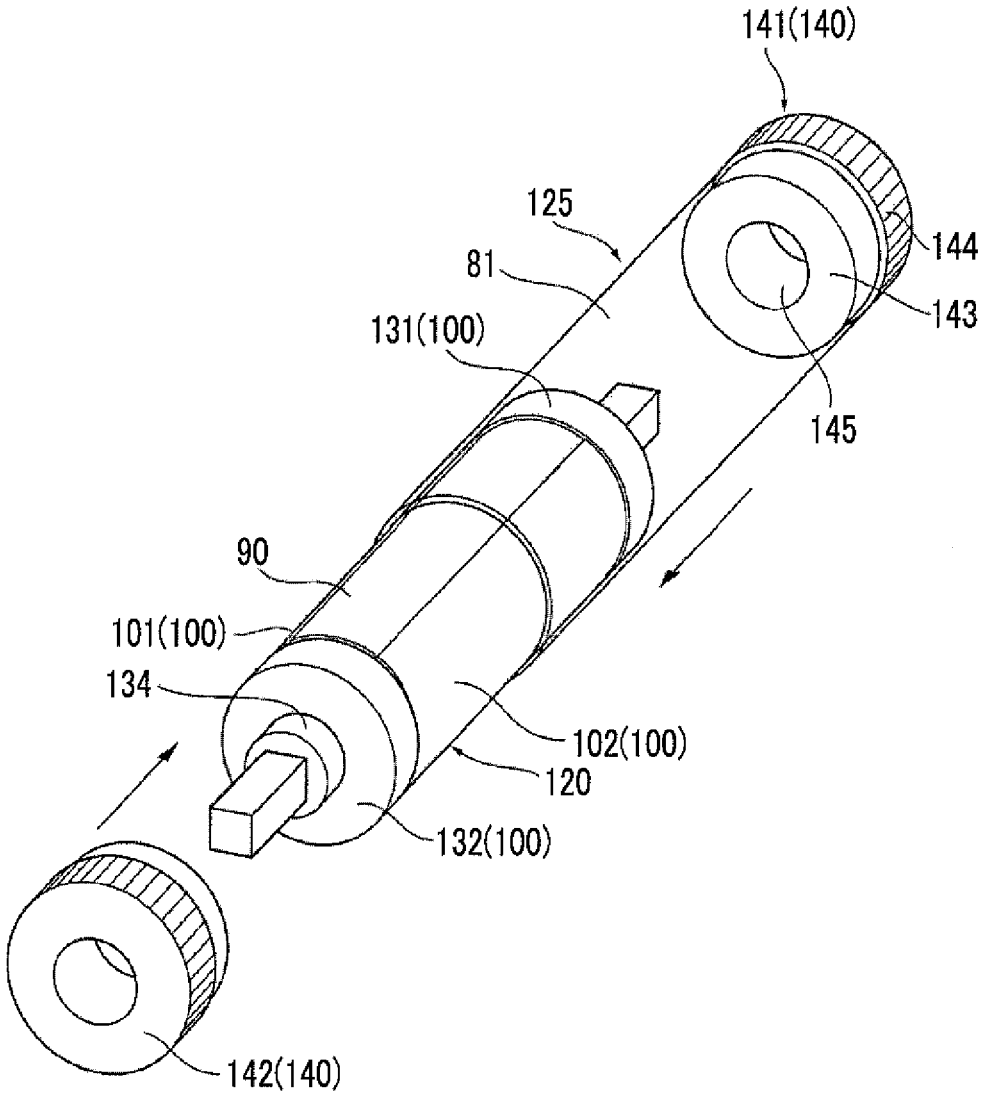
FIG. 6 is a view illustrating an assembled state of each assembling part of the fixing device shown in FIG. 5.

End caps 140 (specifically, end caps 141 and 142) are provided on both ends of the transparent tube 81, as illustrated in FIG. 6. The end caps 140 include end annular bodies 143 and annular gears 144. The end annular bodies 143 are fitted into internal surfaces of both ends of the transparent tube 81. The annular gears 144 are integrally formed on the end annular bodies 143 in a state where the annular gears 144 are adjacent to external sides of the end annular bodies 143 and directly or indirectly apply a rotational driving force to the transparent tube 81.

In this example, the end caps 140 (the end caps 141 and 142) do not completely cover openings of both ends of the transparent tube 81 and are provided with through-holes 145 which communicate with middle portions of the end annular bodies 143 and the annular gears 144.

In this configuration, the guiding step portions 134 of the end holding frames 131 and 132 are inserted into the through-holes 145 of the end annular bodies 143. In addition, the end annular bodies 143 rotate slidably with respect to the guiding step portions 134 of the end holding frames 131 and 132. Furthermore, the spindles 135 of the end holding frames 131 and 132 are disposed to pass through the through-holes 145 of the annular gears 144 and to protrude outside the annular gears 144.

Liquid Application Portion

In this exemplary embodiment, a liquid application portion 150 is provided in the transparent tube 81 to apply the transparent liquid onto the internal surface of the transparent tube 81.

In this example, the liquid application portion 150 is formed of a felt material impregnated with the transparent liquid, such as silicone oil and fluorine oil. The mounting structure of the liquid application portion 150 is as follows.

For example, an attachment groove 110 of which a cross-sectional surface has a rectangular shape is formed on a part of the guiding portion 106 of the side holding frame 101 so as to extend in the longitudinal direction of the laser beam radiation array 84. The liquid application portion 150 is in close contact with the internal surface of the transparent tube 81 in such a manner that the felt material as the liquid application portion 150 is held in the attachment groove 110. The liquid application portion 150 evenly applies the transparent liquid in the liquid application portion 150.

Operation for Inserting Lens Pad Assembly and Liquid Application Portion into Transparent Tube Next, a procedure of an inserting operation of the lens pad 90 into the transparent tube 81 will be described.

First, when the lens pad 90 is held by the holding frame 100, the lens pad 90 is held, in a surrounded manner, by the pair of side holding frames 101 and 102, and then the lens pad 90 and both end portions of the side holding frames 101 and 102 are held by the pair of end holding frames 131 and 132, as illustrated in FIG. 5. Thereby, a lens pad assembly 120 (see FIG. 6) which is constituted by assembling the lens pad 90 and the holding frame 100 is formed.

Meanwhile, as illustrated in FIG. 6, one end cap 140 (the end cap 141, in this example) is mounted to one end opening of the transparent tube 81, and then the lens pad assembly 120 is inserted into the transparent tube 81 from the other end opening side. Next, the guiding step portion 134 of one end holding frame 131 of the lens pad assembly 120 is fitted into the end annular body 143 of one end cap 140 (the end cap 141, in this example) of the transparent tube 81. Next, the spindle 135 of one end holding frame 131 protrudes from the through-hole 145 of the annular gear 144 of the end cap 140 (the end cap 141, in this example). Then, in a state where the lens pad 90 of the lens pad assembly 120 is completely inserted into the transparent tube 81, the other end cap 140 (the end cap 142, in this example) is mounted to the other end opening of the transparent tube 81. Subsequently, the guiding step portion 134 of the other end holding frame 132 of the lens pad assembly 120 is fitted into the end annular body 143 of the other end cap 140 (the end cap 142, in this example). Next, the spindle 135 of the other end holding frame 132 protrudes from the through-hole 145 of the annular gear 144 of the end cap 140 (the end cap 142, in this example).

Furthermore, in this example, when the lens pad assembly 120 is inserted into the transparent tube 81, the liquid application portion 150 impregnated with the transparent liquid may be attached to the lens pad assembly 120 in advance. In this state, the lens pad assembly 120 and the liquid application portion 150 may be inserted into the transparent tube 81.

In the state described above, the operation for inserting the lens pad assembly 120 and the liquid application portion 150 into the transparent tube 81 is finished. As a result, forming of a transparent tube assembly 125 into which the lens pad assembly 120 and the liquid application portion 150 are inserted is finished.

Driving System of Fixing Device

Figure 7:
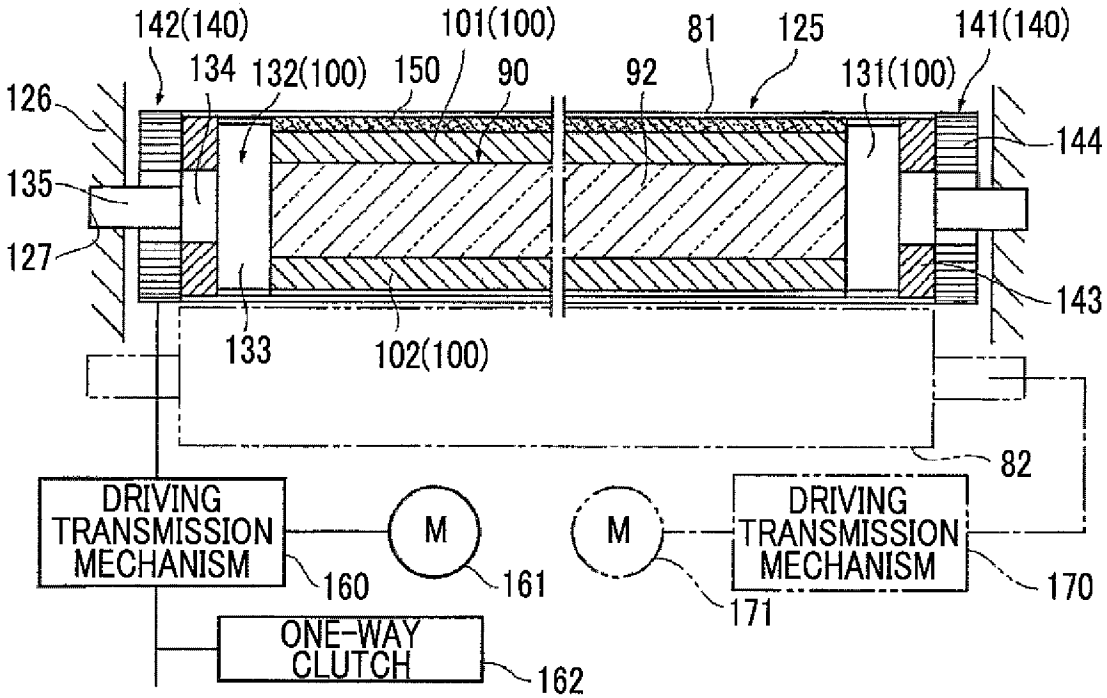
FIG. 7 is a view illustrating an example of a driving mechanism of the fixing device used in the first embodiment.

When forming of the transparent tube assembly 125 is finished, the transparent tube assembly 125 may be mounted to a predetermined portion of the apparatus housing 60, as illustrated in FIG. 7.

At this time, the lens pad assembly 120 of the transparent tube assembly 125 is fixed to the apparatus housing 60 in such a manner that the spindles 135 protruding from both ends of the lens pad assembly 120 are supported, in a fixed manner, by support holes 127 of a fixing device housing 126.

Meanwhile, a driving system of the transparent tube 81 of the transparent tube assembly 125 is configured such that, for example, a driving motor 161 is connected through a driving transmission mechanism 160 to the annular gear 144 of the end cap 140 (the end cap 142, in this example) and a driving force from the driving motor 161 is transmitted through the end cap 140 (the end cap 142, in this example) to the transparent tube 81. Furthermore, in this example, the annular gear 144 is also provided in the other end cap 140 of the transparent tube 81 and this annular gear 144 is rotatably supported by plural supporting gears (not illustrated). Thus, loads applied to both ends of the transparent tube 81 in an axial direction may be balanced.

In this example, the opposing roller 82 also has a driving system separate from the driving system of the transparent tube 81. The driving system of the opposing roller 82 is connected to a driving motor 171 through a driving transmission mechanism 170, such as a gear and a belt. A driving force from the driving motor 171 is transmitted through the driving transmission mechanism 170 to the opposing roller 82.

In this example, the transparent tube 81 and the opposing roller 82 are individually operated by the driving systems separate from each other. Thus, there is a possibility that a large speed difference between the transparent tube 81 and the opposing roller 82 may be caused in the contact region n between the transparent tube 81 and the opposing roller 82.

For this reason, in this exemplary embodiment, for example, a one-way clutch 162 is provided on a part of the driving transmission mechanism 160 of the driving system of the transparent tube 81. Therefore, when a large speed difference between the transparent tube 81 and the opposing roller 82 may be caused in the contact region n, the speed difference between two members in the contact region n is reduced by operating the one-way clutch 162.

In this example, the transparent tube 81 and the opposing roller 82 individually have the driving systems separate from each other. However, without being limited thereto, a driving system may be provided on only the opposing roller 82 side and the transparent tube 81 may move in the contact region n between the transparent tube 81 and the opposing roller 82 to follow the opposing roller 82.

Image Forming Process by Image Forming Apparatus

When the image forming apparatus performs an image forming process, first, an image forming mode select button (not illustrated) is operated, and then a start switch (not illustrated) is turned on.

At this time, the image forming portions 20 (the image forming portions 20*a* to 20*d*) form the images on the photoconductor 21 using the toners of color components, and then the images are successively primary-transferred onto the intermediate transfer body 30, as illustrated in FIG. 3. Next, when the images which are primary-transferred onto the intermediate transfer body 30 reach the batch transfer region (the secondary transfer region), the images are batch-transferred onto the recording material S by the batch transfer device 50, and then the unfixed images on the recording material S are fixed by the fixing device 80.

Fixing Process by Fixing Device

In the fixing device 80 according to this exemplary embodiment, the laser beams Bm radiated from the laser beam radiation array 84 of the laser beam radiation device 83 are converted to parallel laser beams by the collimator lens 86, and then the parallel laser beams Bm are applied to the light incident position A on the transparent tube 81, as illustrated in FIGS. 4 and 8.

Subsequently, the laser beams Bm applied to the light incident position A on the transparent tube 81 pass through the transparent tube 81, and then pass through the light incident portion 92 of the lens pad 90 and the lens main body 91. Then, the laser beams Bm pass through the light emission portion 93, and then pass through the transparent tube 81 again. Next, the laser beams Bm are converged onto the image G which is formed on the recording material S using the toner.

In this state, the image G, which is formed using the toner, is fixed by the laser beams Bm.

During the fixing process described above, the fixing device 80 of this example is operated as follows.

(1) Rotation Operation of Transparent Tube 81

The transparent tube 81 receives the driving force from the driving motor 161, through the driving transmission mechanism 160 and the end cap 142 (the end cap 140). The transparent tube 81 rotates along with the opposing roller 82.

The recording material S is transported in a state where the opposing roller 82 pinch the recording material S in the contact region n between the transparent tube 81 and the opposing roller 82.

At this time, the transparent tube 81 moves in a state where the transparent tube 81 is guided by the periphery of the lens pad assembly 120 having a cylindrical shape. Specifically, the transparent tube 81 is in contact with the light incident portion 92 and the light emission portion 93 of the lens pad 90 and the transparent tube 81 stably rotates in a state where the transparent tube 81 is in contact with the guiding portions 106 of the side holding frames 101 and 102.

(2) Pressurizing and Light-Converging Operation by Lens Pad 90

The lens pad 90 is fixed to a predetermined position through the holding frame 100. The lens pad 90 has the light incident portion 92 which is bent to have the predetermined radius of curvature r1. In addition, the distance L between the light incident portion 92 and the light emission portion 93 has a predetermined distance. Therefore, the laser beams Bm which are applied to the light incident position A on the transparent tube 81 pass through the lens pad 90 having a predetermined depth of focus. As a result, the laser beams Bm are converged to have predetermined light-converging properties. The light emission portion 93 which is positioned in a predetermined position on the lens pad 90 presses the transparent tube 81 against the opposing roller 82 by a predetermined pressurizing force. Therefore, in the contact region n between the transparent tube 81 and the opposing roller 82, the image G which is formed on the recording material S using the toner is subjected to pressurizing treatment and also subjected to heating treatment in the irradiated region p to which the laser beams Bm are applied.

(3) Transparent Liquid Applying Operation

In this example, the liquid application portion 150 impregnated with the transparent liquid, such as silicone oil, is disposed to be in contact with the internal surface of the transparent tube 81. Therefore, transparent liquid 180 is applied to the internal surface of the transparent tube 81.

At this time, although the transparent tube 81 and the light incident portion 92 of the lens pad 90 are disposed to be in contact with each other, an air interface layer 181 is formed in the light incident position A on the transparent tube 81, due to, for example, a curvature difference between the transparent tube 81 and the light incident portion 92. However, in this exemplary embodiment, the air interface layer 181 between the transparent tube 81 and light incident portion 92 is filled with the transparent liquid 180, and thus the laser beams Bm which are applied to the light incident position A on the transparent tube 81 pass through the transparent liquid 180 and reach the light incident portion 92 of the lens pad 90. Therefore, when the transparent liquid 180 is not applied, a part of the laser beams Bm is reflected from the air interface layer 181. However, when the transparent liquid 180 is applied, it is possible to prevent such a reflection phenomenon of the laser beams Bm. Thus, a loss of radiation in the laser beams Bm is reduced.

Furthermore, the transparent liquid 180 is applied to the internal surface of the transparent tube 81. Thus, even in a state where the transparent tube 81 is in contact with a peripheral surface of the lens pad assembly 120, the transparent liquid 180 functions as lubricant which suppresses contact resistance between the transparent tube 81 and the lens pad assembly 120.

Furthermore, in this exemplary embodiment, the liquid application portion 150 is disposed in a portion of the transparent tube 81, which is located further on the upstream side in the rotating direction than the light incident position A and further on the downstream side in the rotating direction than the contact region n. Thus, the air interface layer 181 corresponding to the light incident portion 92 of the lens pad 90 is positioned close to a position to which the transparent liquid 180 is applied by the liquid application portion 150. As a result, the air interface layer 181 is sufficiently filled with the applied transparent liquid 180. In contrast, although the air interface layer 181 is also formed in a portion corresponding to the light emission portion 93 of the lens pad 90, the air interface layer 181 is located spaced apart from a position to which the transparent liquid 180 is applied by the liquid application portion 150. Accordingly, the air interface layer 181 is filled with a proper amount of the transparent liquid 180, and thus undesired reflection of the laser beams Bm from the air interface layer 181 is effectively prevented.

In this example, the light emission portion 93 of the lens pad 90 presses the transparent tube 81 against the opposing roller 82. Thus, the large air interface layer 181 is likely to be formed between the light incident portion 92 of the lens pad 90 and a part of the transparent tube 81, which faces the light incident portion 92. For this reason, it is preferable that an attachment position of the liquid application portion 150 be set as in this example.

(4) Setting of Irradiated Region to which Laser Beam is Applied

Figure 9A:
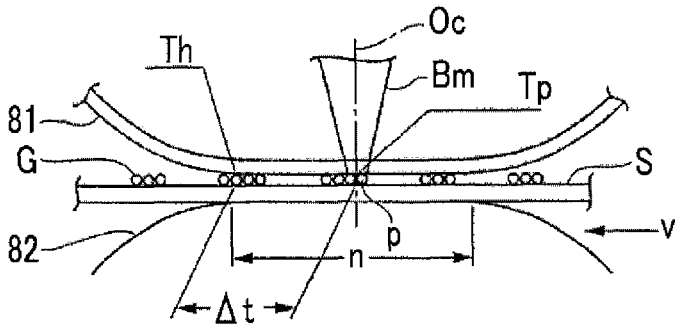
FIG. 9A is a view schematically illustrating a fixing process in a nip region of the fixing device used in the first embodiment and FIG. 9B is an explanatory graph illustrating a temperature change in a toner image when the image is subjected to a laser beam radiation in a fixing process by the fixing device used in the first embodiment.

In this example, the irradiated region p to which the laser beams Bm are applied is set in the vicinity of the substantially middle portion Oc of the contact region n between the transparent tube 81 and the opposing roller 82, as illustrated in FIG. 9A.

Figure 9B:
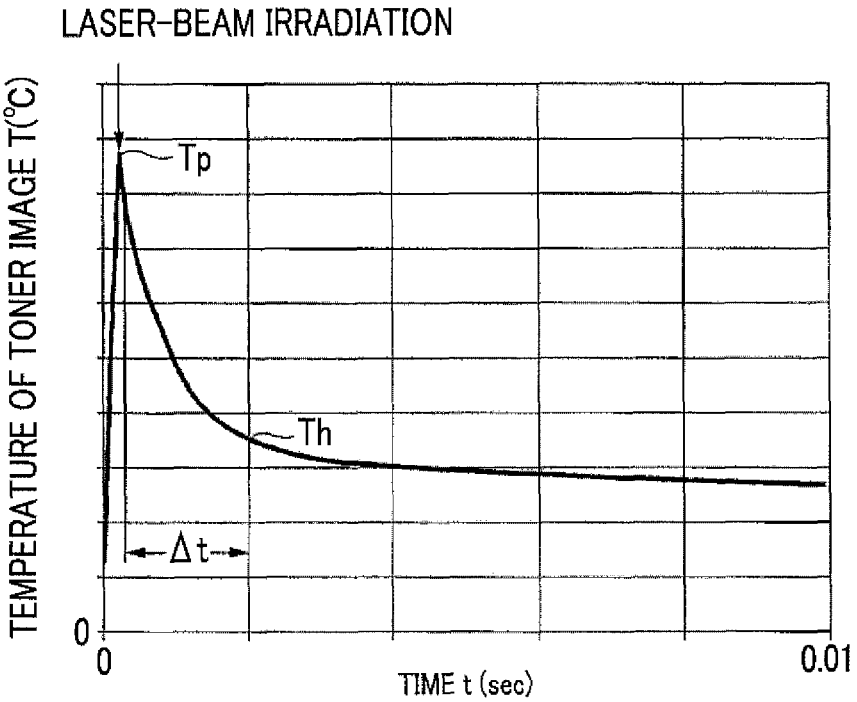

Here, a temperature change in a state where the laser beams are applied onto the toner image and the toner image is not separated from the transparent tube 81 is examined and examination results illustrated in FIG. 9B are obtained. In FIG. 9B, the laser beams are radiated under the condition of 0.2 ms and 0.81 J/cm$^2$.

When referring to FIG. 9B, it is possible to understand following results. A temperature of the toner reaches a peak temperature Tp (for example, 200° C.) immediately after a laser-beam irradiation is performed. The temperature of the toner reaches about Tp/2 (for example, 100° C.) after 1 ms. The temperature of the toner is cooled down to about Tp/3 (for example, 70° C.) after 2 ms. From this result, it is possible to understand that, when the laser beams are applied to the toner image and the toner image stays, for a short period of 1 ms to 2 ms, in the contact region n between the transparent tube 81 and the opposing roller 82, the temperature of the toner image reaches a cooled temperature Th (for example, 70° C. to 100° C.) at which the toner image may be separated from the transparent tube 81.

In the case of this example, when a period in which the peak temperature Tp after the laser-beam irradiation is performed is cooled down to the cooled temperature Th at which the toner image may be separated from the transparent tube 81 is set to Δt, as illustrated in FIG. 9B, a transport speed v of the recording material S may be set to a value at which a period t in which the recording material S is transported from the irradiated region p to which the laser beams Bm are applied to an end of the contact region n, which is located on a downstream side in the transporting direction of the recording material S, in the contact region n between the transparent tube 81 and the opposing roller 82 is equal to or more than Δt, as illustrated FIG. 9A.

The fixing device 80 according to this exemplary embodiment is not limited to the configuration described above. A configuration of the fixing device 80 may be appropriately modified, for example, as illustrated in FIGS. 10A to 13.

Modified First Embodiment

Figure 10A:
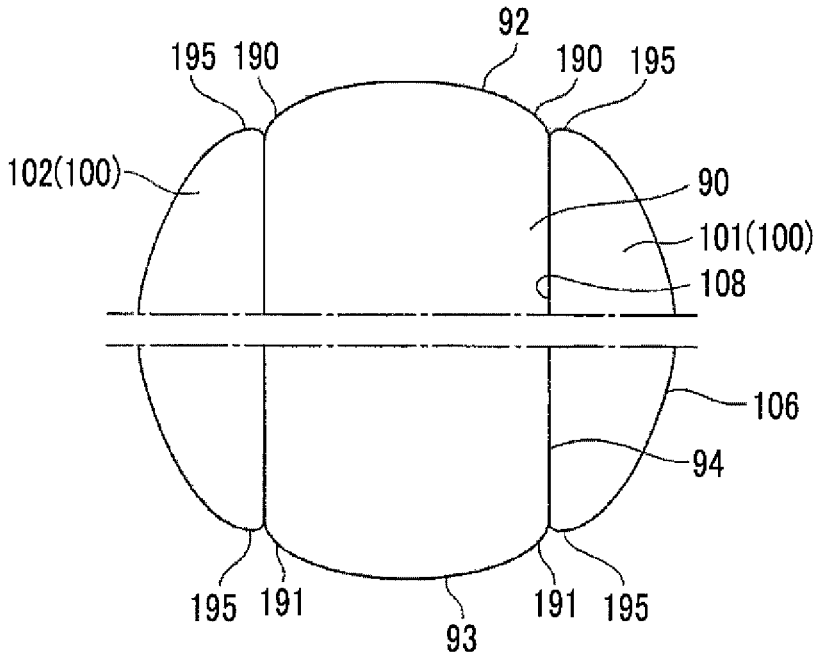
FIGS. 10A and 10B are views illustrating a modification example of a lens pad.

In the lens pad 90 of the exemplary embodiment, the lens main body 91 has the light incident portion 92 in a bent shape and the light emission portion 93 in a bent shape, and the planar portion 94. However, in this modified embodiment, for example, a boundary portion between the light incident portion 92 and the planar portion 94 is bent to form a curved corner portion 190 and a boundary portion between the light emission portion 93 and the planar portion 94 is bent to form a curved corner portion 191, as illustrated in FIG. 10A.

In this example, the radius of curvature of each curved corner portion 190 or 191 is set to be smaller than the radius of curvature of the light incident portion 92 or the light emission portion 93 of the lens pad 90. Therefore, projecting corner portions are not provided in the light incident portion 92 and the light emission portion 93 of the lens pad 90, and thus the transparent tube 81 is not in contact with the projecting corner portions described above. Accordingly, it is possible to ensure favorable sliding movement properties of the transparent tube 81.

In addition, when boundary portions between the guiding portions 106 and the planar portions 108 of the side holding frames 101 and 102, each of which is adjacent to the lens pad 90, are bent to form curved corner portions 195, projecting corner portions are not provided in the side holding frames 101 and 102. Therefore, the transparent tube 81 is not in contact with the projecting corner portions described above, and thus it is possible to ensure favorable sliding movement properties of the transparent tube 81.

Figure 10B:
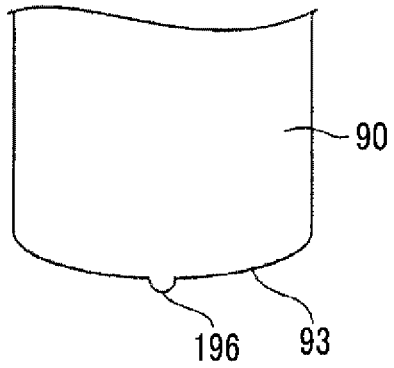

In the modified embodiment illustrated in FIG. 10B, a curved-shaped protrusion 196 is formed in the vicinity of the substantially middle portion of the light emission portion 93 of the lens pad 90 to extend in the longitudinal direction of the lens pad 90. In this case, it is possible to further increase the pressurizing force to the opposing roller 82, which is applied through the transparent tube 81. Therefore, it is possible to perform a fixing process ensuring a further improved fixing strength. In addition, a shape or a position of the protrusion 196 is not limited to that illustrated in FIG. 10B.

Modified Second Embodiment

Figure 11B:
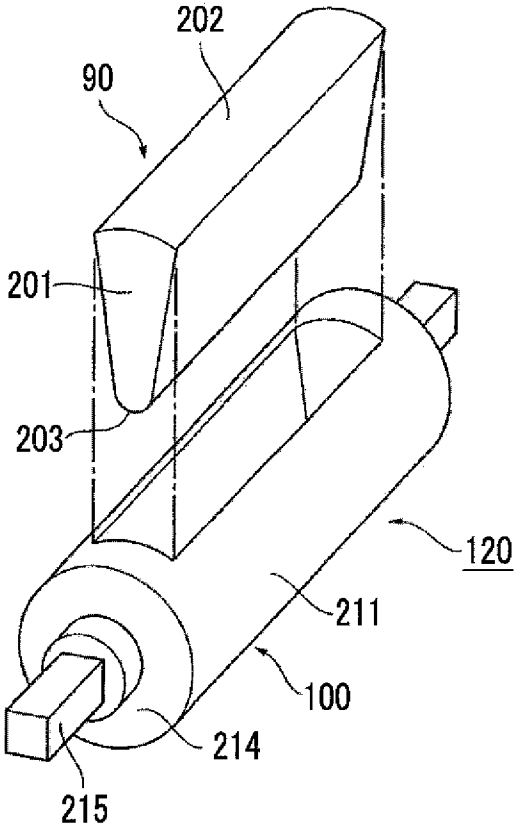
FIG. 11A is a view illustrating a modification example of a lens pad assembly and FIG. 11B is an explanatory perspective view illustrating a principal portion of the lens pad assembly.
Figure 11A:
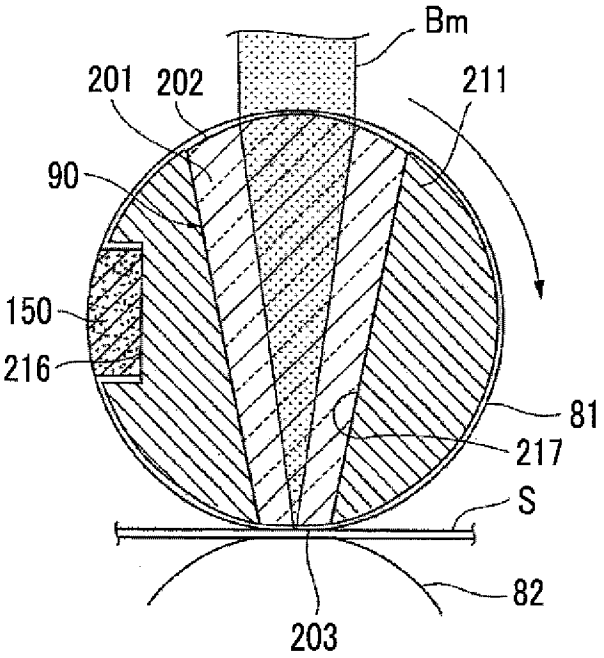

In the exemplary embodiment, the lens pad assembly 120 is formed by inserting the lens pad 90 into the holding frame 100 which is constituted by the side holding frames 101 and 102 and the end portion holding frames 131 and 132. However, without being limited thereto, the lens pad 90 is constituted by, for example, a lens main body 201 of which a cross-sectional surface is a substantially wedge-like shape and in which a light incident portion 202 is formed on a wide width side and a light emission portion 203 is formed on a narrow width side, as illustrated in FIGS. 11A and 11B.

Meanwhile, the holding frame 100 is constituted by a cylindrical portion 211, in which guiding step portions 214 and spindles 215 are integrally formed on both ends of the cylindrical portion 211. In addition, an attachment groove 216 for attaching the liquid application portion 150 is formed in the cylindrical portion 211 and a positioning hole 217 having a shape corresponding to a shape of the lens pad 90 passes through the cylindrical portion 211.

In this example, the lens pad assembly 120 is constituted as follows. The lens pad 90 is inserted into the positioning hole 217 of the holding frame 100. The light incident portion 202 and the light emission portion 203 of the lens pad 90 is held, in a positioned manner, in the holding frame 100 in a state where the light incident portion 202 and the light emission portion 203 are exposed through the peripheral surface of the holding frame 100.

In this exemplary embodiment, a member constituted by the cylindrical portion 211, the guiding step portions 214, and the spindles 215 which are integrally formed is exemplified as the holding frame 100. However, a holding frame main body which includes the cylindrical portion 211 and a side holding frame which includes the guiding step portion 214 and the spindle 215 are separately provided, for example, and, when assembling the lens pad assembly 120, the holding frame main body and the side holding frame may be fixed to each other using an adhesive or the like.

Modified Third Embodiment

Figure 12A:
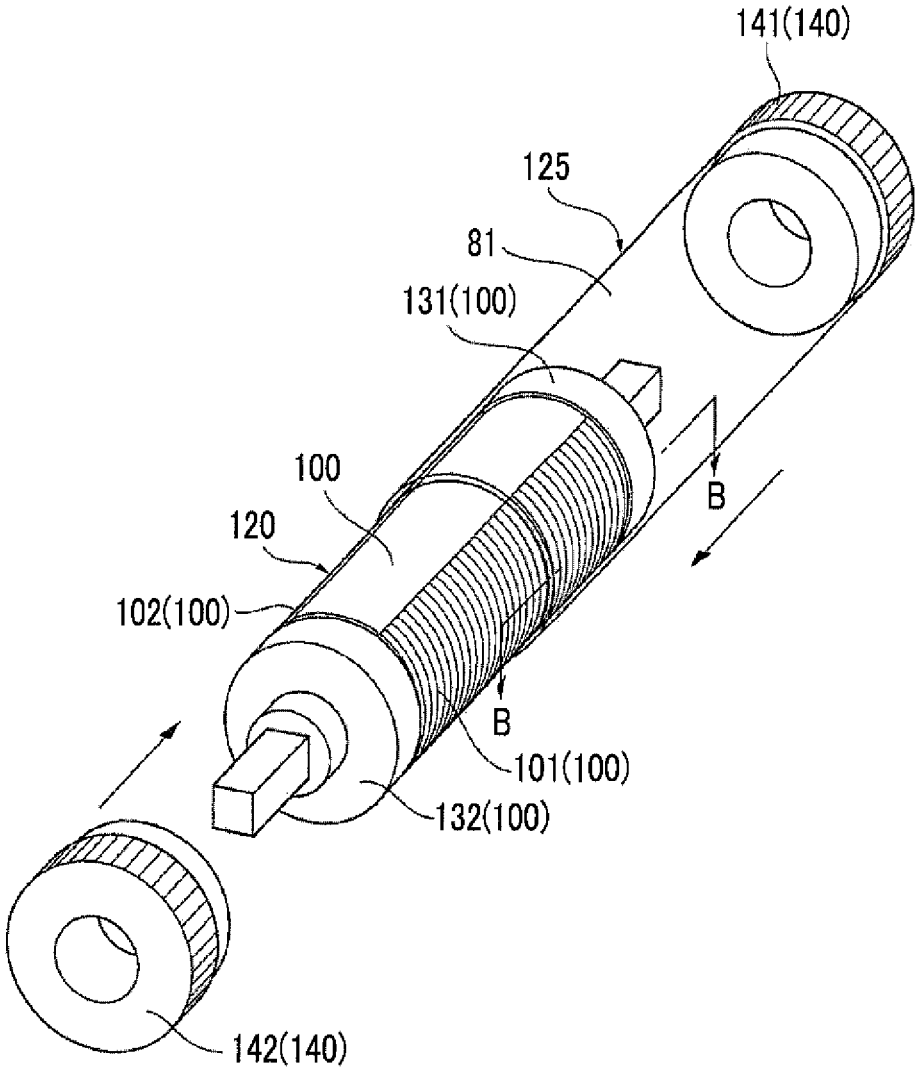
FIG. 12A is a view illustrating another modification example of the fixing device used in the first embodiment and FIG. 12B is an explanatory cross-sectional view thereof taken along line B-B in FIG. 12A.
Figure 12B:
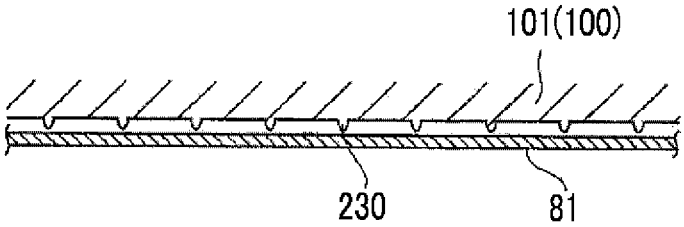

In the exemplary embodiment, the side holding frames 101 and 102 have the guiding portions 106 having a curved shape and the peripheral surface of the guiding portion 106 is formed to be bent. However, without being limited thereto, protrusion ribs 230 of which a cross-sectional surface has a substantially arc shape and each of which extends in a moving direction of the transparent tube 81 are arranged, in the longitudinal direction of the lens pad 90 with predetermined intervals, on the peripheral surface of the guiding portions 106 of the side holding frames 101 and 102, as illustrated in FIGS. 12A and 12B. The transparent tube 81 and the guiding portions 106 of the side holding frames 101 and 102 are disposed to be in contact with each other via the protrusion ribs 230.

According to this aspect, a contact area between the transparent tube 81 and the peripheral surface of the lens pad assembly 120 is reduced, and thus, when the transparent tube 81 rotates, contact resistance between the transparent tube 81 and the lens pad assembly 120 is suppressed to be small.

The same reference numerals as in the first embodiment are given to components having the same configuration as in the first embodiment. Detailed description thereof will not be repeated.

Modified Fourth Embodiment

Figure 13:
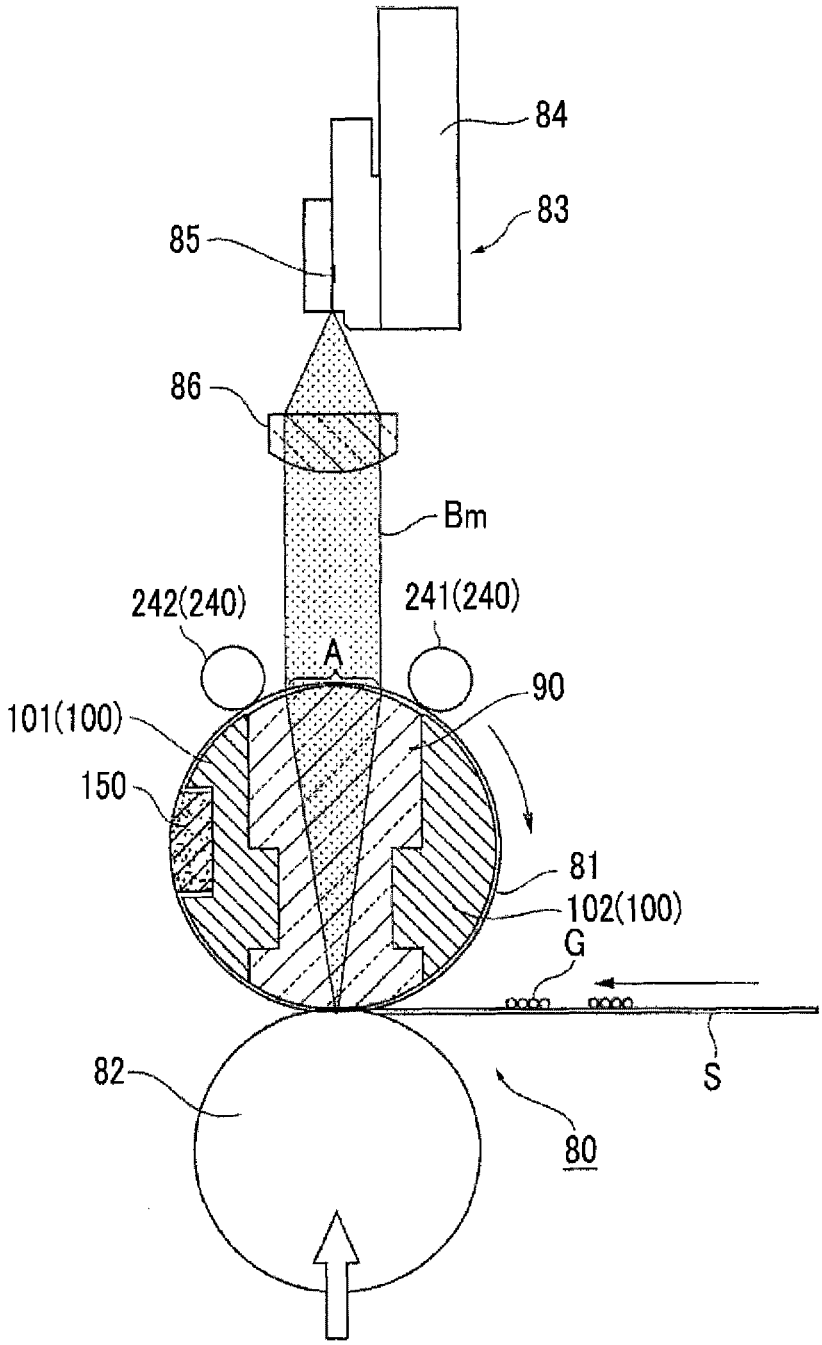
FIG. 13 is a view illustrating another modification example of the fixing device used in the first embodiment.

As illustrated in FIG. 13, this modified embodiment has substantially the same configuration as that in the first embodiment, but is different from the first embodiment in that, in this modified embodiment, a pair of pressing rollers 240 (specifically, pressing rollers 241 and 242) are provided on an external side of the transparent tube 81 as the transparent tube assembly 125. The same reference numerals as in the embodiment are given to components having the same configuration as in the first embodiment. Detailed description thereof will not be repeated.

In this example, the pair of pressing rollers 240 (the pressing rollers 241 and 242) are disposed on both sides of the transparent tube 81 in a state where the light incident position A is interposed between the pair of pressing rollers 240. In addition, the pair of pressing rollers 240 press the transparent tube 81 against the lens pad assembly 120. The pair of pressing rollers are roller members which are formed of metal or synthetic polymer and extend in the longitudinal direction of the transparent tube 81. The pair of pressing rollers rotate to follow a rotation of the transparent tube 81.

In this example, the pressing rollers 240 (the pressing rollers 241 and 242) are disposed on both sides of the transparent tube 81 in a state where the light incident position A is interposed between the pressing rollers 240. Thus, in the portion between the transparent tube 81 and the light incident portion 92 of the lens pad 90, which includes the light incident position A on the transparent tube 81, bulging of the transparent tube 81 is effectively prevented from being caused in at least a portion between the pair of the pressing rollers 240 (the pressing rollers 241 and 242). Therefore, the air interface layer between the transparent tube 81 and the light incident portion 92 of the lens pad 90 is sufficiently filled with the transparent liquid, and thus it is possible to effectively prevent deterioration in filling properties of the transparent liquid due to bulging of the transparent tube 81.

In this example, installation positions of the pair of pressing rollers 240 (the pressing rollers 241 and 242) are optional. However, for effectively suppressing bulging of the transparent tube 81 in a passage through which the laser beams Bm pass, it is preferable that the installation positions thereof be set to positions which are adjacent to the light incident position A and between which the light incident position A on the transparent tube 81 is interposed.

In this example, the pair of pressing rollers 240 are provided. However, the invention is not limited thereto and the pressing roller 240 (the pressing roller 241 or 242) may be provided on one side. In addition, the pressing roller 240 also has other functions (such as functions of a driving roller, a cleansing member, and the like).

Second Embodiment

Figure 14:
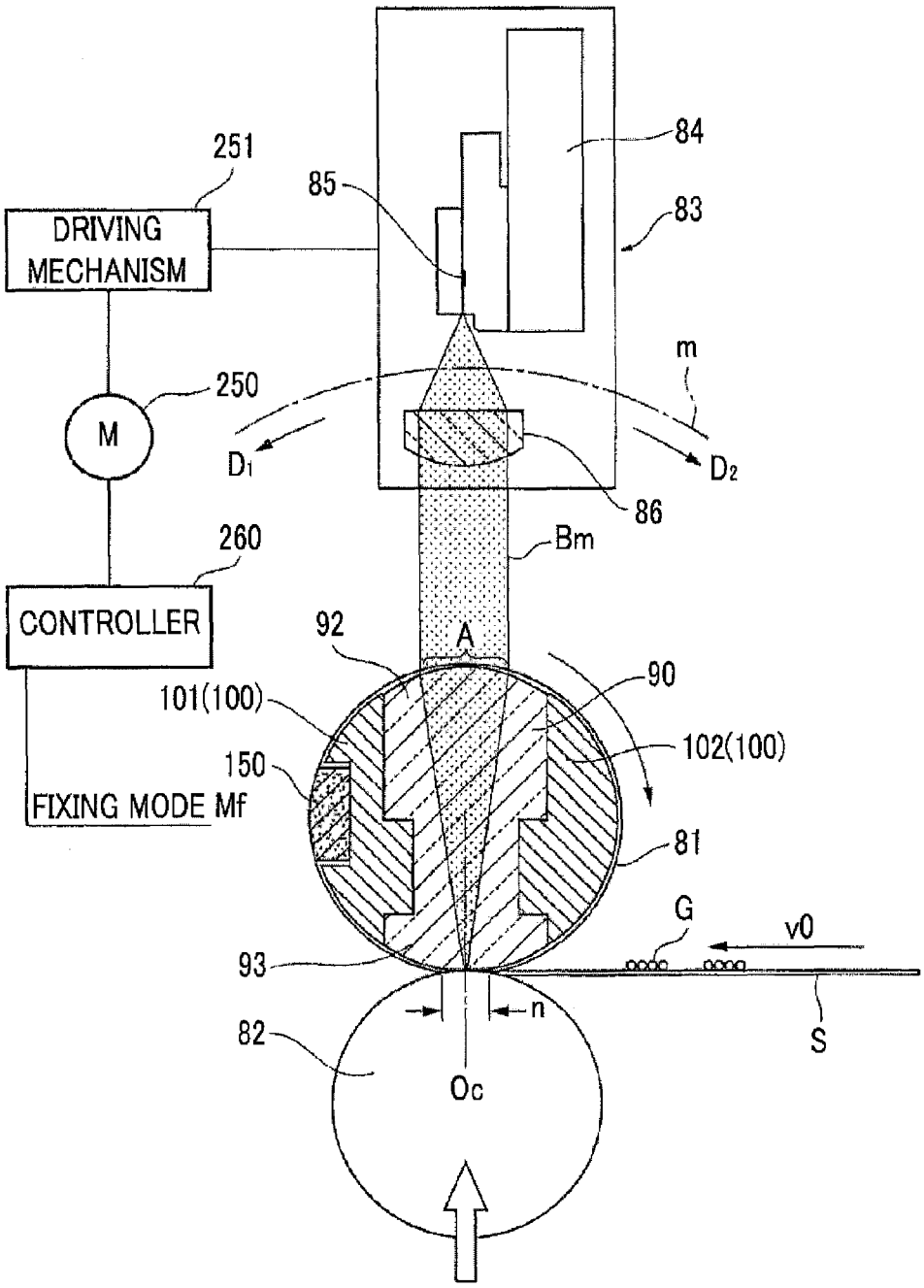
FIG. 14 is a view illustrating an overall configuration of a fixing device used in a second embodiment.

FIG. 14 is a view illustrating a principal portion of the fixing device according to the second embodiment.

In FIG. 14, a basic configuration of the fixing device 80 is substantially the same as that in the first embodiment. However, the second embodiment is different from the first embodiment in that, in the second embodiment, a position of the irradiated region p to which the laser beams Bm are applied may be appropriately changed, in the transporting direction of the recording material S, in the contact region n between the transparent tube 81 and the opposing roller 82.

The same reference numerals as in the first embodiment are given to components having the same configuration as in the first embodiment. Detailed description thereof will not be repeated.

In this example, the laser beam radiation device 83 is provided to be movable along an arc-shaped movement line m which is substantially concentric with a circular rotational track of the transparent tube 81. Thus, the laser beam radiation device 83 appropriately moves along the arc-shaped movement line m by receiving a driving force from a driving motor 250 through a driving mechanism 251.

In this example, a controller 260 changes a fixing position (the position of the irradiated region p of the image on the recording material S, to which the laser beams Bm are applied) by the fixing device 80 of the image forming apparatus in such a manner that the controller 260 switches a transport speed v of the recording material S in accordance with a fixing mode Mf.

In FIG. 14, as similar to the first embodiment, it is assumed that the irradiated region p to which the laser beams Bm are applied by the fixing device 80 is set to be located in the vicinity of, in the transporting direction of the recording material S, the substantially middle portion Oc of the contact region n between the transparent tube 81 and the opposing roller 82. In this case, the transporting speed of the recording material S is set to v0.

High-Speed Fixing Mode

When a high-speed fixing mode is selected as the fixing mode Mf, the controller 260 switches the transporting speed of the recording material S which is transported to the fixing device 80 to a high speed ($v \rightarrow v1$).

Figure 15:
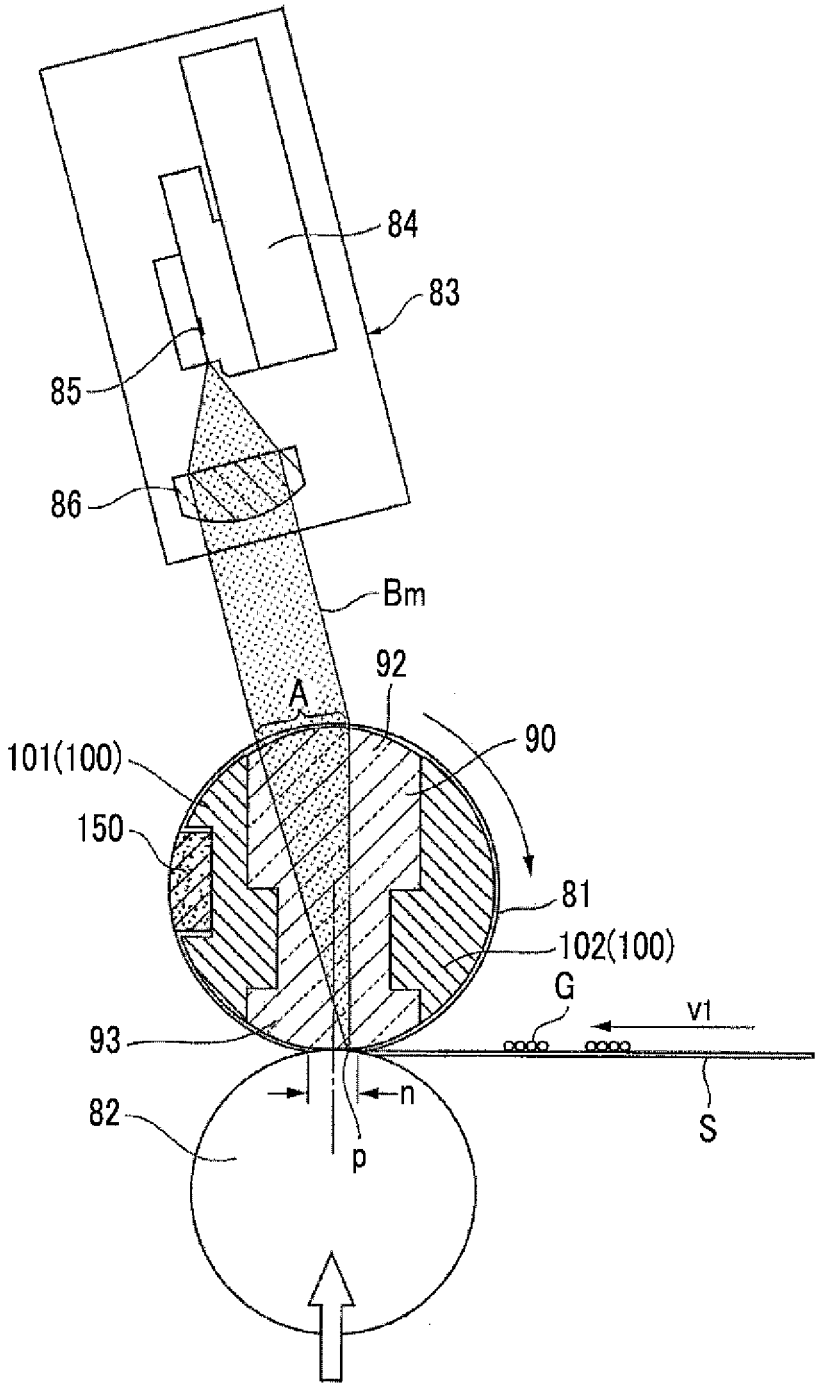
FIG. 15 is a view illustrating a state of the fixing device used in the second embodiment when in a high-speed fixing mode.

At this time, the controller 260 causes the laser beam radiation device 83 to move, through the driving system (the driving motor 250 and the driving mechanism 251), in a D1 direction, along the arc-shaped movement line m, as illustrated in FIGS. 14 and 15.

Therefore, a posture of the laser beam radiation device 83 inclines to a left side in FIG. 15, and thus the light incident position A on the transparent tube 81 is slightly displaced close to the left side in FIG. 15. Accordingly, the laser beams Bm which are applied to the light incident position A on the transparent tube 81 pass through the lens pad 90 and are converged onto the contact region n between the transparent tube 81 and the opposing roller 82.

Figure 17A:
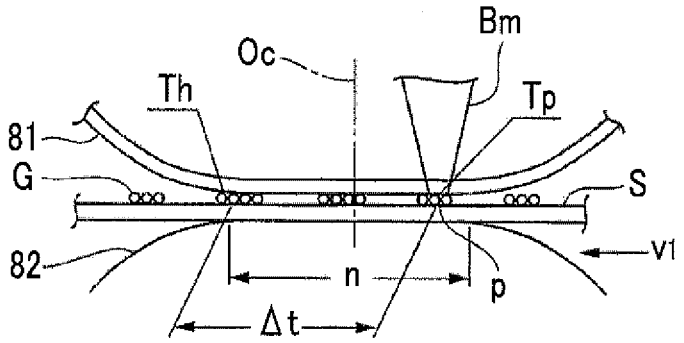
FIG. 17A is a view schematically illustrating a fixing process in a contact region when the fixing device used in the second embodiment is in the high-speed fixing mode and FIG. 17B is a view schematically illustrating a fixing process in the contact region when the fixing device is in the low-speed fixing mode.

In this state, the irradiated region p to which the laser beams Bm are applied is set to a position displaced further on the upstream side in the transporting direction of the recording material S than the substantially middle portion Oc of the contact region n between the transparent tube 81 and the opposing roller 82, as illustrated in FIGS. 15 and 17A.

At this time, in the case of this example, when the period in which the peak temperature Tp after the laser-beam irradiation is performed is cooled down to the cooled temperature Th at which a separation of the toner image may be performed is set to Δt, as illustrated in FIG. 9B, the period t in which the recording material S is transported from the irradiated region p to which the laser beams Bm are applied to the end of the contact region n, which is located on the downstream side in the transporting direction of the recording material S, in the contact region n between the transparent tube 81 and the opposing roller 82, should be set to be equal to or greater than Δt, as illustrated in FIG. 17A. In this mode, it is possible to cool down the toner image in a wide area of the contact region n. Thus, even when the transporting speed v1 of the recording material S is set to a high speed, it is possible to obtain favorable fixing properties.

Low-Speed Fixing Mode

When a low-speed fixing mode is selected as the fixing mode Mf, the controller 260 switches the transporting speed of the recording material S which is transported to the fixing device 80 to a low speed (v→v2)

Figure 16:
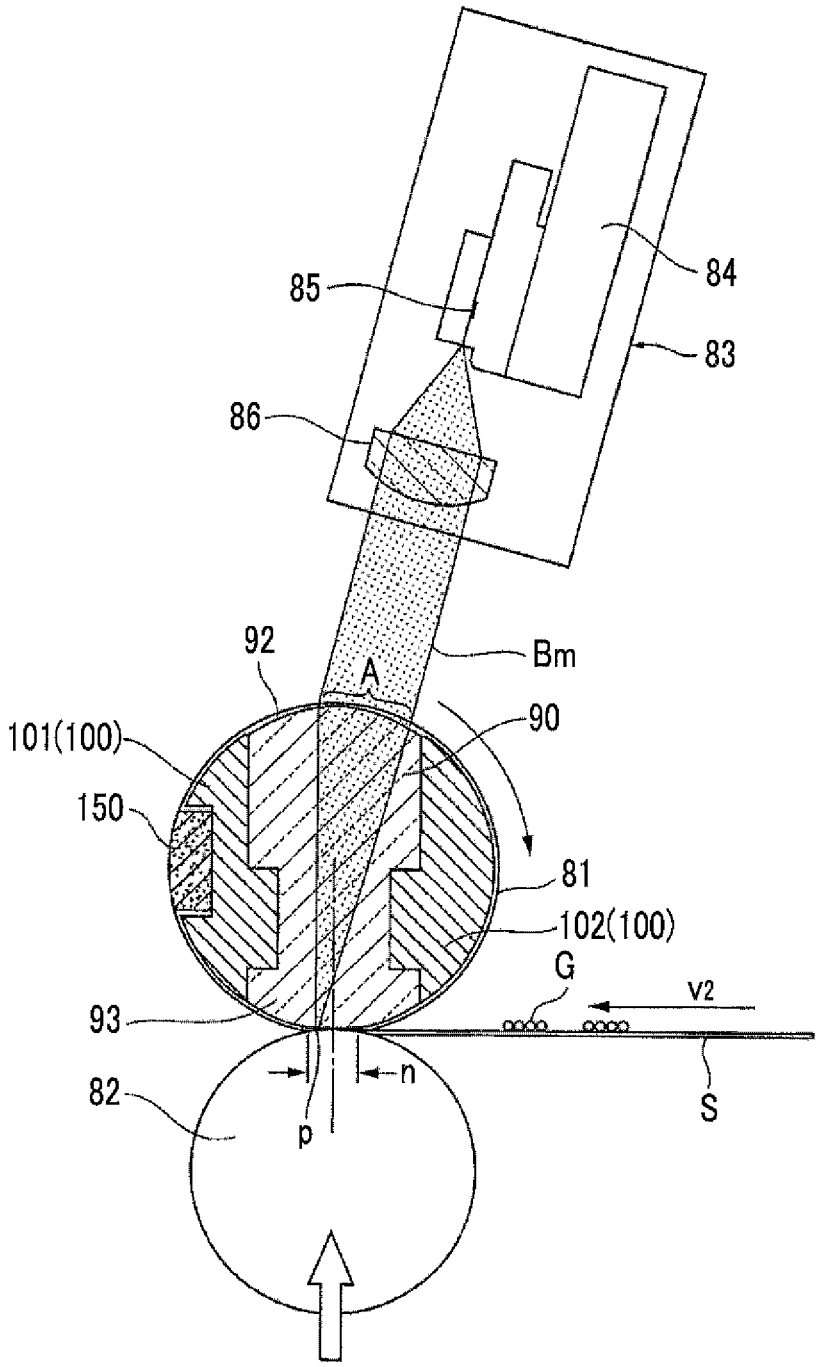
FIG. 16 is a view illustrating a state of the fixing device used in the second embodiment when in a low-speed fixing mode.

At this time, the controller 260 causes the laser beam radiation device 83 to move, through the driving system (the driving motor 250 and the driving mechanism 251), in a D2 direction, along the arc-shaped movement line m, as illustrated in FIGS. 14 and 16.

Therefore, a posture of the laser beam radiation device 83 inclines to a right side in FIG. 16, and thus the light incident position A on the transparent tube 81 is slightly displaced close to the right side in FIG. 16. Accordingly, the laser beams Bm which are applied to the light incident position A on the transparent tube 81 pass through the lens pad 90 and are converged onto the contact region n between the transparent tube 81 and the opposing roller 82.

Figure 17B:
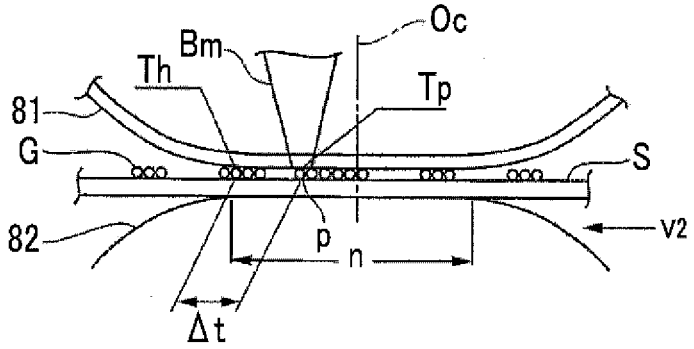

In this state, the irradiated region p to which the laser beams Bm are applied is set to a position displaced further on the downstream side in the transporting direction of the recording material S than the substantially middle portion Oc of the contact region n between the transparent tube 81 and the opposing roller 82, as illustrated in FIGS. 16 and 17B.

At this time, in the case of this example, when the period in which the peak temperature Tp after the laser-beam irradiation is performed is cooled down to the cooled temperature Th at which a separation of the toner image may be performed is set to Δt, as illustrated in FIG. 9B, the period t in which the recording material S is transported from the irradiated region p to which the laser beams Bm are applied to the end of the contact region n, which is located on the downstream side in the transporting direction of the recording material S, in the contact region n between the transparent tube 81 and the opposing roller 82, should be set to be equal to or greater than Δt, as illustrated in FIG. 17B. In this mode, it is possible to cool down the toner image in a narrow area of the contact region n by taking time. Thus, even when the transporting speed v2 of the recording material S is set to a low speed, it is possible to obtain favorable fixing properties. Particularly, in this example, the heated toner image moves in the narrow area of the contact region n, and thus there is a less possibility that the transparent tube 81 or the opposing roller 82 is heated unnecessarily.

In this exemplary embodiment, the passage in the lens pad 90, through which the laser beams Bm are applied to the light incident position A on the transparent tube 81 is changed in accordance with the movement of the laser beam radiation device 83. However, it is preferable that the curvatures of the light incident portion 92 or the light emission portion 93 be finely adjusted in advance so as to ensure the light-converging properties in the irradiated region p to which the laser beams Bm are applied.

Furthermore, in this example, one example of the high-speed fixing mode and one example of the low-speed fixing mode are described. However, one of the high-speed fixing mode and the low-speed fixing mode may be divided into plural stages and performed by switching the plural stages such that the fixing position is changed in accordance with each stage.

In this example, the position of the irradiated region p to which the laser beams Bm are applied is changed in accordance with the fixing mode Mf. However, in an image forming apparatus in which the fixing mode Mf is uniquely predetermined, positions of the irradiated region p in the contact region n, to which the laser beams Bm are applied, may be uniquely determined in advance, in accordance with a high-speed fixing mode, a low-speed fixing mode, and a normal fixing mode.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a transparent cylindrical body that is formed in a cylindrical shape to be rotatable and is made of a transparent material enabling laser beams to pass therethrough;

an opposing member that is arranged to oppose the transparent cylindrical body and forms a contact region in a portion between the transparent cylindrical body and the opposing member and that transports a recording material in the contact region along with the transparent cylindrical body;

a laser beam radiation device that is provided in an external portion of the transparent cylindrical body and radiates the laser beams onto a predetermined light incident position on the transparent cylindrical body;

a light converging member that is provided in an internal portion of the transparent cylindrical body and is disposed to be in contact with portions of the transparent cylindrical body, which at least corresponds to the contact region between the opposing member and the transparent cylindrical body and corresponds to the light incident position and that presses, in the contact region, the transparent cylindrical body to an opposing member side and converges the laser beams, which are radiated onto the light incident position so as to be applied to an image on the recording material, in a transporting direction of the recording material, in the contact region; and a liquid filling body that, when the transparent cylindrical body rotates, fills an air interface layer between a portion of the transparent cylindrical body, which at least corresponds to the light incident position, and the light converging member, with a transparent liquid enabling the laser beams to pass therethrough.

2. The fixing device according to claim 1, wherein the light converging member includes a light incident portion that is formed in a portion corresponding to the light incident position on the transparent cylindrical body and is bent in a direction along a rotating direction of the transparent cylindrical body, and a light emission portion that is formed in a portion corresponding to the contact region between the transparent cylindrical body and the opposing member and is bent in a direction along a rotating direction of the transparent cylindrical body.

3. The fixing device according to claim 1, wherein the light converging member includes a light incident portion that is formed in a portion corresponding to the light incident position on the transparent cylindrical body and is bent in a direction along a rotating direction of the transparent cylindrical body, and the light incident portion is bent with a radius of curvature equal to or smaller than a radius of curvature of an internal surface of the transparent cylindrical body.

4. The fixing device according to claim 1, wherein the light converging member is positioned to and held by a holding member that is provided in an internal portion of the transparent cylindrical body.

5. The fixing device according to claim 4, wherein the holding member includes a holding portion that holds the light converging member and a guiding portion that is in contact with the internal surface of the transparent cylindrical body and guides a rotational track of the transparent cylindrical body.

6. The fixing device according to claim 1, wherein the liquid filling body is a liquid application member that is provided in a fixed manner in an internal space of the transparent cylindrical body and applies the transparent liquid in a state where the liquid filling body is in contact with the internal surface of the transparent cylindrical body, except portions of the internal surface of the transparent cylindrical body, which correspond to the light incident position on the transparent cylindrical body and the contact region between the transparent cylindrical body and the opposing member.

7. The fixing device according to claim 1, further comprising:

a pressing member that is provided in the vicinity of a portion of an external surface of the transparent cylindrical body, which corresponds to the light incident position, to press the transparent cylindrical body such that a portion of the transparent cylindrical body, which corresponds to the light incident position, is in contact with the light converging member.

8. An image forming apparatus comprising:

an image forming device that forms an unfixed image on a recording material; and the fixing device according to claim 1, that transports the recording material on which the unfixed image formed by the image forming device is held and fixes the unfixed image on the recording material.

* * * * *